US008056728B2

(12) United States Patent
Riise et al.

(10) Patent No.: US 8,056,728 B2
(45) Date of Patent: Nov. 15, 2011

(54) METHODS, SYSTEMS, AND DEVICES FOR SEPARATING MATERIALS USING MAGNETIC AND FRICTIONAL PROPERTIES

(75) Inventors: Brian L. Riise, San Ramon, CA (US); Ron C. Rau, Coeur D'Alene, ID (US); Hyung Baek, Pinole, CA (US); Pedro Alejandro Perez-Rodriguez, Emeryville, CA (US)

(73) Assignee: MBA Polymers, Inc., Richmond, CA (US)

( * ) Notice: Subject to any disclaimer, the term of this patent is extended or adjusted under 35 U.S.C. 154(b) by 311 days.

(21) Appl. No.: 12/414,838

(22) Filed: Mar. 31, 2009

(65) Prior Publication Data

US 2010/0078362 A1 Apr. 1, 2010

Related U.S. Application Data

(60) Provisional application No. 61/041,089, filed on Mar. 31, 2008, provisional application No. 61/044,156, filed on Apr. 11, 2008.

(51) Int. Cl.
*B03C 1/00* (2006.01)

(52) U.S. Cl. ..... 209/8; 209/219; 209/631; 209/689

(58) Field of Classification Search ..... 209/8, 219, 209/629, 631, 636, 638, 689
See application file for complete search history.

(56) References Cited

U.S. PATENT DOCUMENTS 861,782 A * 7/1907 Wait ..... 209/8
1,318,003 A * 10/1919 Wheeler et al. ..... 209/45
1,414,170 A * 4/1922 Bethke et al. ..... 209/226
3,929,627 A 12/1975 Frangiskos et al.
4,225,426 A 9/1980 Price et al.
4,839,033 A * 6/1989 Sano et al. ..... 209/4
5,161,694 A 11/1992 Yoon et al.
5,303,826 A * 4/1994 Buzga ..... 209/46
6,382,427 B1 * 5/2002 Nakhei-Nejad ..... 209/700
6,467,629 B1 * 10/2002 Exner ..... 209/219
7,063,213 B2 * 6/2006 Allen et al. ..... 209/3

(Continued)

FOREIGN PATENT DOCUMENTS

EP 119442 A2 * 9/1984

(Continued)

OTHER PUBLICATIONS

Authorized Officer Begoña Abad Mesa, Invitation to Pay Additional Fees and, Where Applicable, Protest Fee in PCT/US2009/038900 mailed Sep. 14, 2009, 4 pages.

(Continued)

*Primary Examiner* — Joseph C Rodriguez
(74) *Attorney, Agent, or Firm* — Fish & Richardson P.C.

(57) ABSTRACT

A method for separating mixtures of solid materials includes incorporating a ferromagnetic particulate material into a mixture of solid materials and, after the incorporating step, separating the mixture of solid materials into at least two groups based on the magnetic and frictional properties of the different components of the mixture of solid materials. The ferromagnetic particulate material can differentially incorporate into or adhere to different components of the mixture of solid materials. The different components of the mixture have different frictional properties and, after the incorporating step, the different components have different magnetic properties.

11 Claims, 12 Drawing Sheets

U.S. PATENT DOCUMENTS

| | | | |
|---|---|---|---|
| 7,111,738 | B2 | 9/2006 | Allen |
| 2006/0001187 | A1 | 1/2006 | Allen et al. |
| 2009/0188842 | A1 | 7/2009 | Spangenberger et al. |

FOREIGN PATENT DOCUMENTS

| | | | |
|---|---|---|---|
| FR | 2411635 | A | 7/1979 |
| WO | WO2006106234 | A1 | 10/2006 |

OTHER PUBLICATIONS

Authorized Officer Jeanne Bauer, International Search Report/Written Opinion in PCT/US2009/038900 mailed Nov. 20, 2009, 17 pages.

International Preliminary Report and Written Opinion for Application No. PCT/US2009/038900, dated Oct. 14, 2010, 9 pages.

* cited by examiner

METHODS, SYSTEMS, AND DEVICES FOR SEPARATING MATERIALS USING MAGNETIC AND FRICTIONAL PROPERTIES

CROSS-REFERENCE TO RELATED APPLICATIONS

This application claims the benefit of Provisional Application No. 61/041,089, filed Mar. 31, 2008, and Provisional Application No. 61/044,156, filed Apr. 11, 2008, which are incorporated by reference herein.

TECHNICAL FIELD

This disclosure relates to material separations, including recycling plastics from streams of waste plastics and other materials.

BACKGROUND

The recovery of plastics from waste streams such as durable goods is a considerable challenge due the presence of several types of plastics as well as non-plastics contaminants. High purity flakes recovered from a recycling process can be extruded and pelletized to make a high quality product, but such extrusion can be difficult and the quality of the product can be poor unless certain types of contaminants are reduced to very low levels prior to extrusion.

Such problematic contaminants include, among others, non-plastics such as wood, particle board, paper, cardboard, rubber, textiles, metallic coatings, wires and circuit boards. Because such materials do not properly melt during the recycling process, they can quickly block melt filtration equipment used during the extrusion step even when these contaminant materials are present in small amounts. Non-melt particles smaller than the size of screens used for melt filtration can pass through the melt filtration equipment and end up as cosmetic and/or mechanical defects in products. In addition, cellulose-based contaminants (i.e., wood, particle board, cardboard and paper) can start degrading at extrusion temperatures typical for many thermoplastics. Therefore dark specks of degraded material can disintegrate from the original contaminant particles and pass through the melt filtration equipment. In addition, some plastics contain coatings, such as metallic paint or metal plating, that can cause similar difficulties in the extrusion step and in the products derived from extrusion of recycled plastics.

Some thermoplastics and thermosets found in durable goods are rigid foam materials known as structural foam. In some cases, this structural foam may contain flame retardants, glass fibers, residual blowing agents or other additives that could reduce the mechanical properties or marketability of the final product. In addition, the porous structure of these structural foams means that their density is lower than the density of the actual solid portion of the material.

In order to create flakes of a size suitable for extrusion from durable goods, the recycling process can include at least one and typically two or more size reduction steps. These steps can include the use of shredders, hammer mills, rotary grinders, granulators, or various other size reduction processes known in the art.

For at least some of the size reduction steps, the mixture containing plastics from durable goods also typically contains ferrous metals as well as slightly magnetic metals, such as alloys containing nickel, cobalt, molybdenum, vanadium, chromium or titanium. During the size reduction process, the high pressures and/or rapid cutter speeds tends to embed small fragments of these magnetic materials into some of the non-magnetic materials in the mixture. Small fragments worn from the size reduction equipment itself can also embed in these same non-magnetic materials.

Plastic recycling processes also typically include a wide array of conveying equipment, bins and chutes, many of which are made of steel. Over time, the steel abrades from equipment in contact with the plastics-rich mixture, and this abraded magnetic material can therefore be present in the mixture in trace amounts. Screw conveyors are one form of conveying equipment where this principle may occur, but there are other locations throughout the process as well.

Recycling processes can use high strength magnetic rods to prevent the accidental introduction of metals, such as small metal screws, into the extruder. Arrays of such magnets are, for example, sold by vendors such as Eriez Magnetics (Erie, Pa.) as grate magnets. Because there are very few such magnetic particles, the magnetic rods can easily capture the particles. The rods may be cleaned relatively infrequently and still perform their function of capturing the stray magnetic particles.

Another process sometimes included in the recycling process for durable goods is density separation. One method for separating plastics by density at densities greater than 1.0 is to use slurries of particulates, such as titanium oxide, magnetite or ferrosilicon. The particulate slurries can have a well-defined particle size distribution for improved separation.

In the following, additional methods, systems and devices are described for the selective removal of contaminant materials from plastic flakes.

SUMMARY

Methods, systems, and devices are described for separating mixtures of solid materials based on magnetic and/or frictional differences between the materials.

In some aspects, a method includes incorporating a ferromagnetic particulate material into a mixture of solid materials and, after the incorporating step, separating the mixture of solid materials into at least two groups based on the magnetic and frictional properties of the different components of the mixture of solid materials. The ferromagnetic particulate material can differentially incorporate into or adhere to different components of the mixture of solid materials. The different components of the mixture have different frictional properties and, after the incorporating step, the different components have different magnetic properties.

In some aspects, a method includes incorporating a ferromagnetic particulate material into a mixture of solid materials, separating at least a portion of the mixture of solid materials into at least two groups based on the density of the different components of the mixture of solid materials after the incorporation of the ferromagnetic particulate material, and separating at least a portion of the mixture of solid materials into at least two groups based on the magnetic properties of the different components of the mixture of solid materials after the incorporation of the ferromagnetic particulate material.

In some aspects, a method includes supplying a stream of a mixture of solid materials to a surface of a rotating member and collecting a plurality of subgroups of the mixture of solid material from the surface of the rotating member. The rotating member rotates about an axis that is not perpendicular to the direction of gravity. The surface of the rotating member has a downward slope that is not perpendicular to the axis of rotation. Accordingly, each collected subgroup is defined by the amount of movement of the different components of the mixture of solid materials in a direction perpendicular to the direction of the downward slope due to the rotation of the rotating member.

In some aspects, a method includes supplying a stream of a mixture of solid materials to a stationary inclined surface and collecting a plurality of subgroups of the mixture of solid materials based on different trajectories of the different components of the mixture of solid materials as the materials fall off a lower edge of the stationary inclined surface. The mixture of solid materials includes different components having different frictional properties such that each component of the mixture of solid materials contacts the stationary inclined surface and travels downward along the surface due, at least in part, to gravitational force. The different trajectories are based on the frictional properties of the different components of the mixture of solid materials.

BRIEF DESCRIPTION OF THE DRAWINGS

FIG. 10A is a side view and FIG. 10B is a top view.

FIG. 11A is a side view and FIG. 11B is a top view.

FIG. 23A is a side view and FIG. 23B is a top view.

FIG. 24A is a top view and FIG. 24B is a side view.

DETAILED DESCRIPTION

Figure 1:
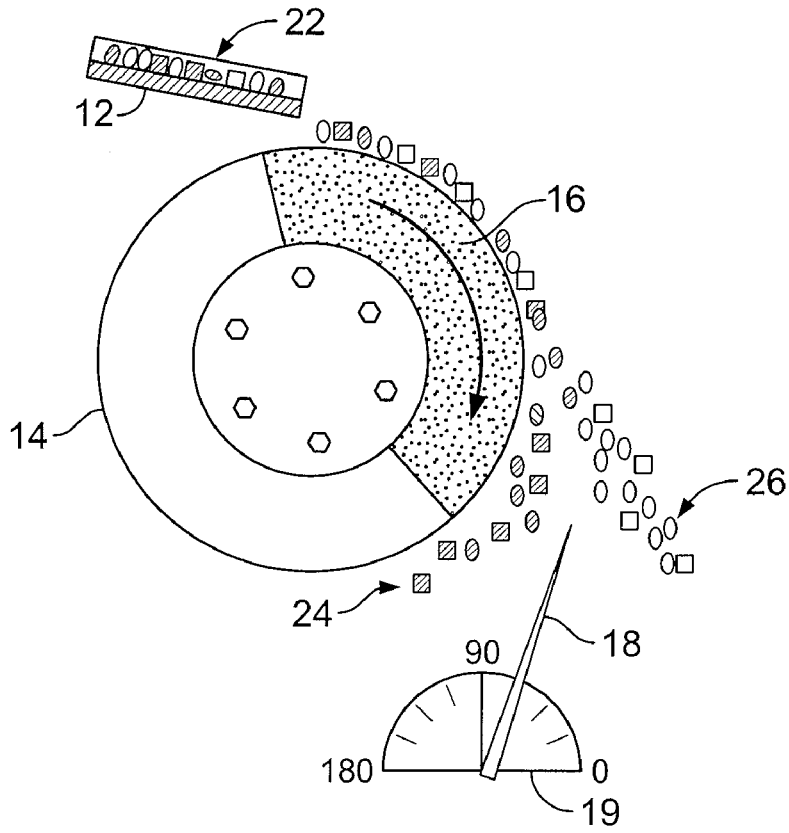
FIG. 1 shows a high strength magnetic drum in which the drum rotates in the same direction as the flow of feed material. The fixed magnetic portion of the drum is shaded.

This application describes methods, systems, and devices for separating materials based on magnetic and/or frictional differences between the materials. In some embodiments, the differences in both magnetism and frictional properties can be exploited in a single step and/or with a single system or device. In some embodiments, these methods, systems, and devices can be used in combination with other processes for the separation of materials. For example, the described methods, systems, and devices can be used in a recycling plant for the recovery of plastics from goods containing plastics. These processes can be used at one or more locations in the overall process of separating plastic material from other materials in a recycling plant.

The methods, systems, and devices described herein can separate materials based on the magnetic differences between materials. In some embodiments, magnetic materials are differentially incorporated into or attached to different types of materials in a way similar to the way particles are incorporated in elevated density separation procedures (e.g., as described in U.S. Pat. No. 7,111,738, which is hereby incorporated by reference). For example, a small amount of a magnetic material (e.g., magnetite or ferrosilicon) can be incorporated into or adhered to the materials to be separated by immersing the materials in a dense aqueous suspension of a magnetic particles (e.g. magnetite). The suspension can have a well-defined particle size distribution.

Based on the different porosities of the different materials, the particles in the suspension differentially incorporate into or adhere to the different materials to be separated. For example, magnetic particles larger than around 5 microns do not tend to stick strongly to plastic flakes, especially after the flakes are rinsed. This is because typical plastic fracture surfaces tend to have voids that are smaller than 5 microns. Larger particles therefore have no place to stick to the flake when the flakes are rinsed, and/or subjected to mechanical action after the elevated density separation.

In contrast to most plastic flakes, contaminants in a plastic recycle stream such as wood, particle board, fiberboard, paper, cardboard, cloth, thermoplastic foams and thermoset foams tend to be very porous. These contaminants, which can be woven and non woven fibrous materials, can absorb particles in pores that are much larger than 5 microns. Therefore, fibrous materials and foam materials tend to capture a larger mass of particles than solid plastics. In addition, foam materials and fibrous materials tend to have rough surfaces on which large numbers of particles can stick due to the recesses in the surface. These foam materials and fibrous materials therefore readily absorb magnetic particles used in the elevated density separation as well as some small magnetic metal fragments abraded from size reduction and conveying equipment and/or other metal particles present in the recycle stream.

Rubber particles are sometimes porous as well. A fraction of the rubber found in streams of durable goods waste is foamed rubber that can readily capture small particles in its interior. Other rubber that is not foamed can also capture small particles when sufficient pressure is applied to the magnetic particles to press them into the soft rubber surface. Rubber particles therefore readily absorb magnetic particles used in the elevated density separation as well as some small magnetic metal fragments abraded from size reduction and conveying equipment.

The voids in the exposed interiors of structural foam materials can capture magnetic particles in much the same way as wood or foamed rubber. These structural foam materials therefore readily absorb magnetic particles used in the elevated density separation as well as some small magnetic metal fragments abraded from size reduction and conveying equipment.

Plastics with residual adhesive on the surface can also preferentially adhere to magnetic particles. Once the adhesive is contacted by the magnetic particles, the particles stick strongly to the plastic surface. Plastics with residual adhesive therefore readily adhere to magnetic particles used in the elevated density separation as well as some small magnetic metal fragments abraded from size reduction and conveying equipment.

Fine magnetic particles stick to all particles in the mixture to some extent, especially in the absence of rinsing or when rinsing is insufficient to remove the fine magnetic particles. Copper is non-magnetic, for example, but small amounts of magnetic particles can adhere to copper wires or thin copper pieces, making the copper slightly magnetic. Copper wires are often very thin, so they have a very large surface area to mass ratio. Because the magnetic coating is on the surface, these particles can be readily attracted to magnets. This same principle applies to thin pieces of slightly magnetic aluminum or aluminum coated films.

As described above, magnetic particles are captured by some of the materials in the plastic-rich stream after size reduction, mechanical conveying operations or elevated density separation processes using magnetic particulates. If the amount of magnetic material in some of the materials is sufficient for them to be attracted to a magnet, and if there is some differential magnetism between some of the contaminant materials (i.e., wood, rubber and foamed plastic) and the target materials (i.e., non-foamed plastic), it should be possible to reduce the amount of unwanted contaminants in the plastic flake products by including magnets somewhere after size reduction and/or the elevated density separation.

The methods, systems, and devices described herein can be arranged to allow for different magnetic separation sensitivities. The sensitivity of a particular method, system, or device can depend on a number of factors, which can include, for example, the strength and field depth of the magnet used, the velocities of the components of the mixture of materials relative to the magnet, and the arrangement and velocity of the different parts of the apparatus used. As an example of how sensitivities can be adjusted, the amount of magnetic particles adhering to surfaces of components of the mixture. Simple calculations suggest that the amount of magnetic particles (e.g., 10 micron diameter magnetite particles) is approximately 1 percent by volume if present as a complete monolayer on the surface of a smooth 4 mm diameter particle that is 2 mm thick. Magnetic particles might only cover less than about 10 percent of the surface of some materials to be separated from the mixture of materials. Accordingly, some of these materials might have between 0.01 percent and 0.1 percent by volume of magnetic particles. Magnetic particles sticking to plastic surfaces, however, might be closer to 1-5 microns in diameter, and the fractional coverage might be lower than 1 percent due to fewer 1-5 micron particles in the dense aqueous suspension. The amount of magnetic particles for 4 mm plastic particles would therefore be less than about 0.001 percent by volume. Accordingly, the sensitivity of some methods, systems, or devices described herein can allow for the separation of components of the mixture of materials having greater than between about 0.001 volume percent and about 0.1 volume percent magnetic material. The magnetic particles can include both magnetic particles incorporated into or adhered to the components of the mixture of materials and other contaminants present in the mixture of materials. For example, a less sensitive separation process could remove components of a mixture of materials having about 0.1 volume percent or more magnetic material, a more sensitive process could remove components having about 0.01 volume percent or more of magnetic material, and a still more sensitive process could remove components having about 0.001 volume percent or more of magnetic material. The methods, systems, and devices described herein, for example, can be tuned to a particular sensitivity based on the expected composition of the mixture of materials to be separated.

The amount of magnetic particles on the surface of component particles can also be controlled by the particle size distribution of the magnetic particles in the slurry, how well the magnetic particles are rinsed from the particles and how much the particles are subjected to mechanical action that might further embed the magnetic particles into the particles in the mixture or abrade magnetic particles from the particles in the mixture. The sensitivity of the magnetic separation can, for example, be selected based on the amount of residual magnetic particles on the materials. In some embodiments, the magnetic separation process can be tuned based on how well the particles are rinsed off after the density separation.

The methods, systems, and devices described herein can also separate materials based on the differences in the frictional behavior of different materials. For example, an amount of friction against a surface for a piece of material can be based on the intrinsic surface and bulk properties as well as on the contact area against the surface. The frictional forces acting on each of the different components of the mixture of materials against the surface, however, are also based on the dynamic frictional properties of the components as they tumble or bounce along the surface. For example, plastic material can experience lower amounts of frictional forces in dynamic processes than contaminant components in a mixture of materials. The amount of frictional force exerted on the different components of the mixture of materials depends on the properties of the apparatus used and the operation of that apparatus. The different methods, systems, and devices can be designed to allow for different frictional separation sensitivities depending on the desired purity of the resulting separated groups of materials and the expected composition of the mixture of materials to be separated. In some embodiments, the sensitivity can be based on an amount of movement of the different components due to frictional forces in comparison to an average amount of movement for the components of the desired final product.

Wood is a contaminant that has a high effective frictional force against surfaces because it tends to lie flat on surfaces and because the surface area tends to be high relative to the mass of the wood particles.

Rubber tends to have a high frictional force against surfaces because it tends to be softer and tackier than thermoplastics and can therefore grab surfaces more effectively than thermoplastics.

Fabric and textiles also tend to have a high frictional coefficient against surfaces. Fabrics tend to be flexible, so they can lie flat on surfaces and therefore have a greater contact area than thermoplastics, which are rigid unless stress is applied to force them to conform to surfaces. Fabrics also tend to have a very high surface to mass ratio, and can be easily dragged against the force of gravity.

Foam is soft and also has an extremely high surface to mass ratio. It can therefore be easily dragged against the force of gravity.

Similarly, fine particles have a higher surface to mass ratio, and therefore a high friction to mass ratio. Fine particles can therefore be dragged against the force of gravity.

Wires can also have a greater frictional force relative to plastics. Wires typically exist in long and flexible pieces (and can be very thin), thus much of their surface may be in contact with other surfaces (e.g., conveyance equipment). Because wires also are very dense relative to plastics and some of the other contaminants, they do not tend to bounce as much. Therefore, wires are often in greater total frictional contact with surfaces, even though the actual frictional forces of wires against a surface may not be any greater than plastics. Note also that the wire can be a slightly magnetic material in some cases.

Coated wires and cables have different frictional properties than plastic materials and thus can be separated from plastic materials based on friction. The jacketing on wires and cables is often either rubber or plasticized PVC, thus coated wires and cables often have high friction. Note also that the metal conductor can be slightly magnetic.

Circuit boards can also end up as thin fragments after size reduction, and these thin fragments have different frictional properties than plastic materials and thus can be separated from plastic materials based on friction. Circuit boards also can contain ferromagnetic material.

Accordingly, in the following, methods of using magnetic and frictional differences to enable the selective removal of contaminant materials from plastic flakes are described.

A recycling plant for the recovery of plastics from durable goods typically includes a number of process steps. For example, U.S. Patent Application Publication No. 2006/0001187, which is hereby incorporated by reference, describes various sequences of various process steps for the removal of contaminants from plastics recycle streams. The methods, systems, and devices described herein can be used in sequence with or in substitution for the various process steps described in U.S. Patent Application Publication No. 2006/0001187. These sequences of processes apply to both streams derived from durable goods and to streams of packaging materials, bottles or other mixtures rich in plastics. The process can include the use of one or more size reduction steps performed on a plastics-rich mixture from durable goods. The feed mixture can be shredded material from which some metal has been removed. The durable goods themselves can be size reduced two or more times prior to extrusion.

A mixture rich in plastic material can be processed through size reduction equipment one or more times. The size reduction steps can include rotary grinding, hammermill size reducing, shredding, granulating, or any other size reduction processes known by those skilled in the art. The plastic-rich mixture can also contain rubber, wood and other non-plastics. The flakes can range in size from around 1 mm to around 50 mm, although the process works best when the particles are between about 2 mm and about 10 mm. Size reduction, in some embodiments, can precede the elevated density separation process. In other embodiments, size reduction can also follow the density separation process to create a final flake size between about 2 mm and about 10 mm. In other embodiments, a density separation process is not used.

The mixture rich in plastic flakes can be processed through an elevated density separation in which a magnetic material (e.g., magnetite) is used to create a dense aqueous suspension, for example as described in U.S. Pat. No. 7,111,738, which is hereby incorporated by reference. The elevated density separation may be carried out in any of the types of density separation equipment. For example, hydrocyclones can efficiently separate materials of different densities based on the high centrifugal forces present in the liquid slurry swirling inside a cyclone. Within hydrocyclones, pressures on the order of 0.5 to 2 bar above atmospheric pressure, which can cause magnetic materials to enter porous materials and/or embed in softer materials even better than under ambient conditions are used.

An appropriate rinsing step can be used after the elevated density separation. The rinsing step may include, for example, using small water jets that are designed to rinse the majority of the magnetic particles off the materials in the plastic-rich flake mixture. The rinsing system should be sufficient to rinse magnetic material off plastics, but not so intense that it scours the magnetic particles off of materials in which the magnetic particles embed preferentially (e.g., rubber).

The mixture can also be dried in a controlled manner after the elevated density separation. Flake materials tend to adhere to surfaces if the surfaces are overly damp or wet, and this can result in poor separation performance for some of the processes described herein.

Mechanical conveyance processes can be used after the elevated density separation. Mechanical conveyance processes can apply pressure to flake-rich mixtures and therefore "press" magnetic material onto material surfaces so that it can preferentially embed in wood, rubber and other soft materials. The same mechanical action tends to "scour" plastic surfaces and scrape magnetic particles off of the plastic surface to therefore further improve the separation process.

Magnetic particles can also be incorporated into different materials without the use of the elevated density separation process. In some embodiments, suspended magnetic particles are incorporated or adhered to the materials for separation without the use of a density separation process. In other embodiments, magnetic particles can be incorporated using other methods. For example, magnetic material can be incorporated into the material during the size reduction processes. The incorporation of the magnetic material can then be used to separate materials based on the magnetic properties of the materials. In other embodiments, a combination of magnetic and frictional properties of the materials can be exploited to separate the materials without the prior incorporation of magnetic materials.

Magnets and/or separators can be used to exploit differences in frictional properties of materials. In some embodiments, processes that exploit differences in both magnetism and frictional properties can be combined in a single step. These various processes using magnetic and/or frictional differences can be used at one or more locations in the overall process of purifying mixtures including plastics.

Magnets can be used after at least some of the size reduction steps and after the elevated density separation. Magnets can be employed advantageously at a variety of process locations, and their use in multiple locations is desirable in order to extract the maximum amount of undesirable materials. High strength magnets can enable the removal of many of the contaminants from the plastic-rich mixtures. High strength magnets include rare earth magnets such as neodymium-iron-boron magnets and samarium-cobalt magnets, or high strength electromagnets. In some embodiments, high strength magnets are used because the magnetic attraction of most of the materials involved in the separations described here are too small when employing lower strength magnets such as ceramic magnets. High strength magnets can be employed in different geometries and configurations and with different field strengths at the various locations throughout the process. Magnets with slightly higher magnetic field strengths can be appropriate for slightly larger particles because the magnetic components of the particles may be embedded in the surface and the surface to mass ratio is lower for the large particles. The magnetic force (in comparison with forces such as gravity) is therefore lower for larger particles. Lower magnetic field strengths can be more useful when attempting to remove high surface area to mass materials such as foam and magnetic dust. Higher strength magnetic field strength magnets, however, can be used for foam and magnetic dust because the highly magnetic materials can strongly adhere to the magnet and limit the magnetic attraction of larger materials lower magnetism to mass ratios. Super high field strength magnets can also be used. In some embodiments, the process employs multiple magnets with magnetic strengths progressively increasing from the feed end towards the product end.

The amount of magnetic material incorporated into the plastics containing mixture can be present at levels between 0.01% and 50%, or more typically at levels between 0.1% to 10%. Removal of the slightly magnetic material present in the mixture at these levels with fixed rod grate magnets, such as those sold by Eriez Magnetics (Erie, Pa.), requires frequent cleaning of the rods, which leads to significant downtime and/or incomplete separation of the magnetic material. Accordingly, the instantly described methods, systems, and devices use high strength magnets that are built into rolling drums or pulleys or are configured in some other way to enable their continuous use. In addition to the need for continuous use, rotation provides a benefit of utilizing some frictional differences that tend to further enhance the separability of the more magnetic materials from the less magnetic materials. High strength drum or roller magnets of the type used in the currently described process may be purchased from a number of suppliers. One such supplier is Eriez Magnetics (Erie, Pa.).

Referring to FIG. 1, a high strength magnetized drum 14 can be fed using a method that provides a uniform flow of a single layer of material 22 over the drum 14. Feed material 22 includes magnetic material 24 and non-magnetic material 26. Such methods can include vibratory feeders 12, for example. Feeding devices that provide pulses of material, such as screw conveyors or bucket elevators, may also be used.

Figure 2:
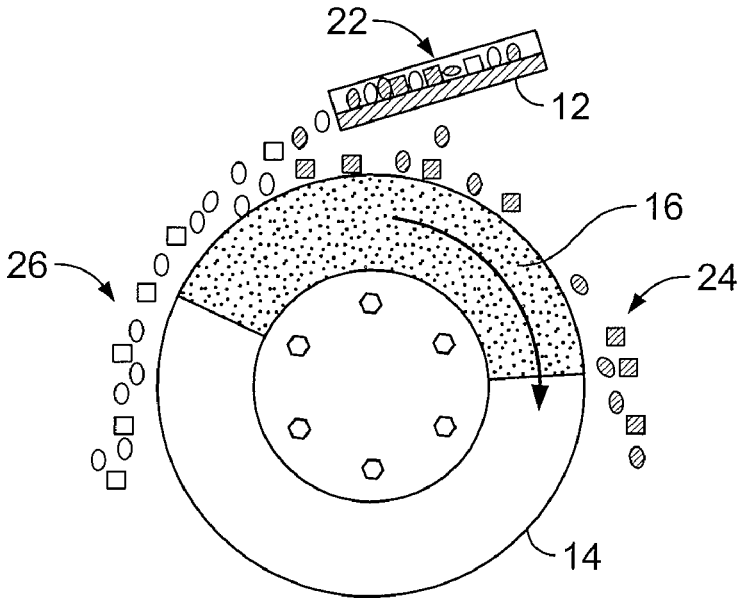
FIG. 2 shows a high strength magnetic drum in which the drum rotates in the opposite direction as the flow of feed material.

The drum 14 may operate in either a forward or reverse mode, as shown in FIGS. 1 and 2 respectively. The shell of drum 14 can be made of stainless steel or a polymer (e.g., polycarbonate, high density polyethylene, or acrylonitrile butadiene styrene). For example, a sheet of acrylonitrile butadiene styrene (ABS) or high density polyethylene (HDPE) can be applied to a stainless steel shell to form the drum 14. The drum 14 can have a diameter of between 20 cm and 90 cm (e.g., between about 30 cm and 60 cm). The drum can rotate at a rate of 20-100 rpm (e.g., about 35 rpm). The drum 14 can include a non-rotating interior magnet portion 16 (shaded) and a non-magnetic rotating exterior shell. The non-rotating interior magnet portion 16 can be provided by providing one or more non-rotating interior magnets that magnetizes the portion of the drum adjacent to the magnets as the drum 14 rotates. In the forward mode, shown in FIG. 1, most magnetic materials 24 attach to the drum 14 and are dragged around circumferentially until being released somewhere beneath the drum 14. For example, magnetic materials 24 can be released once they reach a non-magnetic portion of the drum due to the force of gravity. The magnet can be under less than 80% of the surface, for example, less than 50%, or less than 25% of the surface. In other embodiments, scrapers, brushes or other means can be used to separate magnetic materials 24 from the drum 14. Non-magnetic materials 26 do not magnetically adhere to the drum 14 and thus can flow in a different path off of the drum 14. Devices can be used to separate the different flows of different materials. As shown, a diverter 19 having an extended separating surface 18 is used to separate the flows into a first group of primarily magnetic materials 24 and a second group of primarily non-magnetic materials 26. The exact compositions of the different flows can be optimized by adjusting the placement of the diverter 19 and the angle of the extended separating surface 18. For example, slightly magnetic materials will project off of the roller at a different trajectory than more highly magnetic materials, thus the placement of the diverter can determine how magnetic a material needs to be, relative to weight and size, to be included in either the "magnetic" or "non-magnetic" flow.

Figure 19:
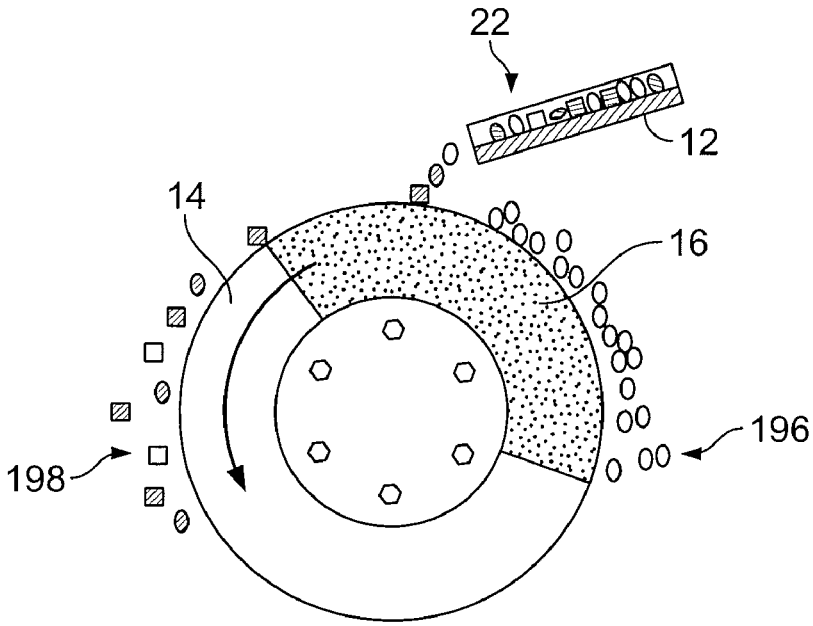
FIG. 19 shows a high strength magnetic drum in which the drum rotates in the same direction as the flow of feed material.

The placement of the feeder 12 relative to the drum 14 can also impact the different flows formed. For example, FIG. 19 depicts an arrangement where the feeder 12 is located behind a drum 14 including a non-rotating magnetic interior portion 16. Because plastics typically have lower friction against the drum surface, plastic particles can slide backwards if the feeder 12 is placed such that the feed mixture 22 makes contact with the drum 14 at a back side of the forward rotating drum. This can allow for more frictional materials, such as rubbers, to move forward with the magnetic materials while the plastic materials flow in an opposite direction. Accordingly, a feed mixture 22 can be separated into a purified stream 196 and a byproduct stream 198, the byproduct stream 198 including both magnetic materials and highly frictional impurities.

In the reverse mode, as shown in FIG. 2, non-magnetic material freely falls forward while magnetic materials attach to the magnet and are carried backwards prior to being released behind the drum. The relative placement of the feeder 12 and the drum 14 will impact the compositions of the different flows of materials. Also, the interior portion of the drum that is magnetic will also impact the compositions. Furthermore, in some embodiments, such as in FIG. 20, the drum 14 can also cause highly frictional materials, such as rubber, to also flow backwards along with the magnetic material 24. Accordingly, a thermoplastic flakes rich material can be purified of both magnetic materials, and/or impurities adhered to magnetic materials, and highly frictional impurities, such as rubber particles, using a single operating unit.

A system with high strength magnet rolls can include pulleys made of high strength magnets that rotate beneath a thin belt. Such a separator is shown schematically in FIG. 3. Particles of a feed mixture 22 are conveyed along the belt 32 and stick to the belt as long as the belt is close to the magnetic pulley 36. The belt can be made of Kevlar and have a thickness of between 0.125 and 0.7 mm. The belt can travel at a speed of about 10-200 cm/s (e.g., between 50 and 100 cm/s). The magnetic particles fall off the belt once the belt passes the magnetic pulley to create a flow of primarily magnetic materials 24. Non-magnetic materials do not adhere to the belt 32 while the belt 32 is close to the magnetic pulley 36, thus these materials can flow in a different direction. A drive pulley 34 can also be used to drive the movement of the belt. The magnetic and drive pulleys 34 and 36 can have a diameter of between 10 and 15 cm (e.g., about 10 cm). The flows of material can be separated by, for example, a diverter 19 using an extended separating surface 18. The compositions of the groups of separated materials can depend on the placement of diverter and the angle of the extended separating surface 18.

A system with multiple stages of high strength magnet drums or rollers may be employed. For example, feed mixture 22 can be fed from above and will drop past multiple separation stages. Nearly all of the slightly magnetic material can be removed with the multiple separation stages, and the stages can be configured such that very little target material is lost with the stream containing the slightly magnetic contaminants.

Other types of continuous high strength magnet processes can be in-line belt or cross belt magnets constructed with rare earth magnets or electromagnets.

Separators which exploit differences in frictional properties can also enable the efficient removal of certain types of contaminants found in plastic-rich streams recovered from durable goods. These methods, systems, and devices can include the use of rotating rollers, disks or other three dimensional objects.

These friction-based separators can be fed using standard feeding devices that provide a uniform feed. Such devices can include vibratory feeders, for example, although other devices such as screw conveyors or even controlled-flow chutes from hoppers can be used.

Figure 5:
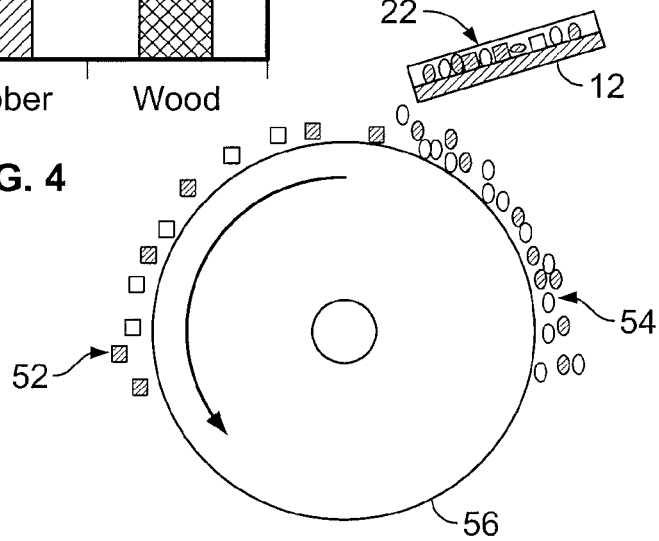
FIG. 5 shows a Perpendicular Roller Separator (PRS) in forward mode.

One separator configuration for contaminant removal based on friction is called the perpendicular roller separator ("PRS"). Referring to FIG. 5, the PRS consists of a rotating cylinder 56 which is fed from the side and above. The rotating cylinder 56 can be made of stainless steel, nickel plated steel, or a polymer (e.g., polycarbonate, high density polyethylene, or acrylonitrile butadiene styrene). For example, a sheet of ABS or HDPE can be applied to a stainless steel shell to produce the rotating cylinder 56. The rotating cylinder 56 can have a diameter of between 20 cm and 40 cm (e.g., about 30 cm). The rotating cylinder 56 can rotate at a rate of 20-200 rpm (e.g., between 40 and 60 rpm). The rotation of the cylinder 56 tends to grab higher friction materials 52 (e.g., rubbers) as it rotates while allowing lower friction materials 54 (e.g., plastics) to slide downward in the direction of gravity and against the rotational direction.

Figure 6:
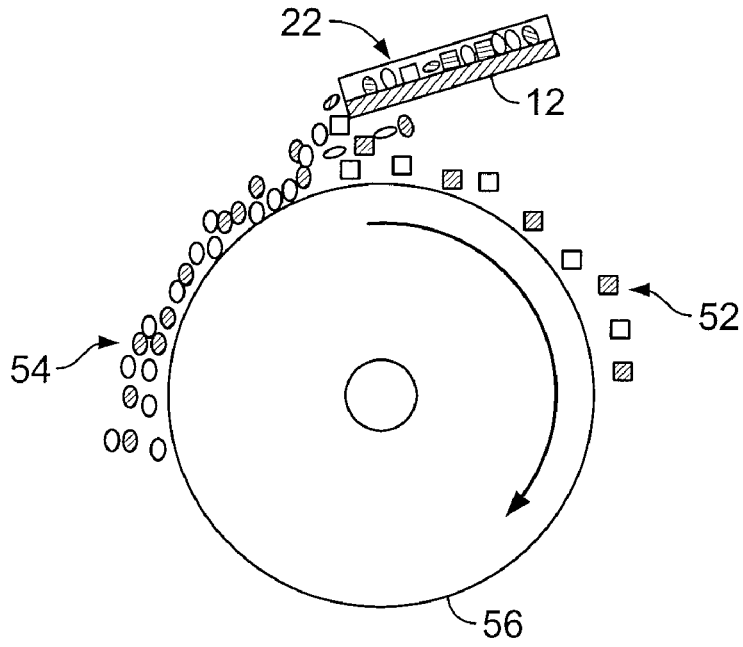
FIG. 6 shows a Perpendicular Roller Separator (PRS) in reverse mode.
Figure 7:
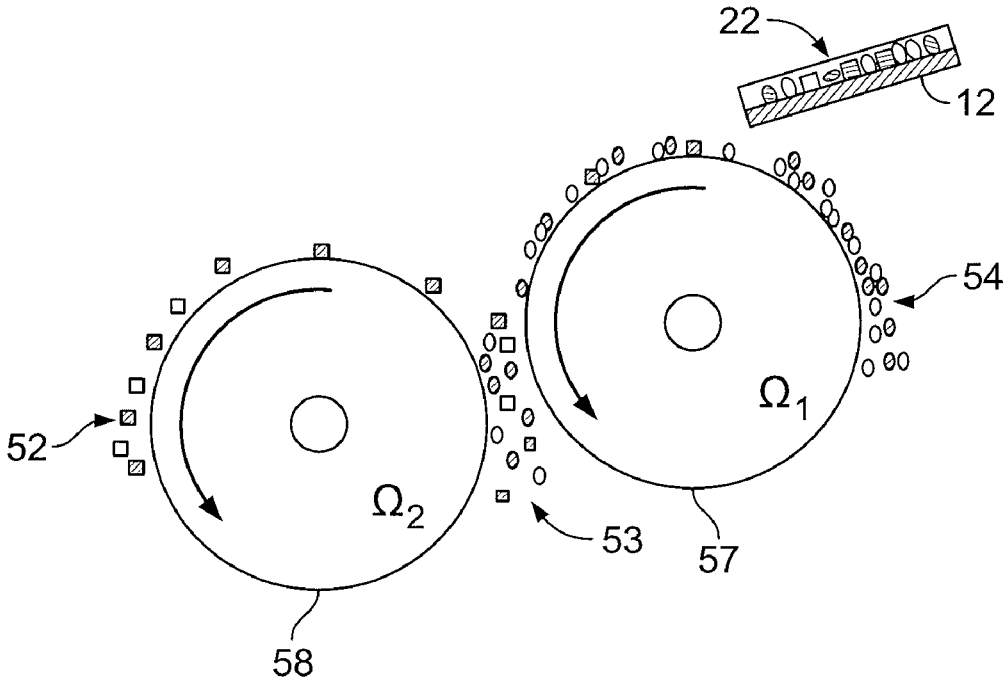
FIG. 7 shows a co-rotating Dual Forward Perpendicular Roller Separator (DFPRS).
Figure 8:
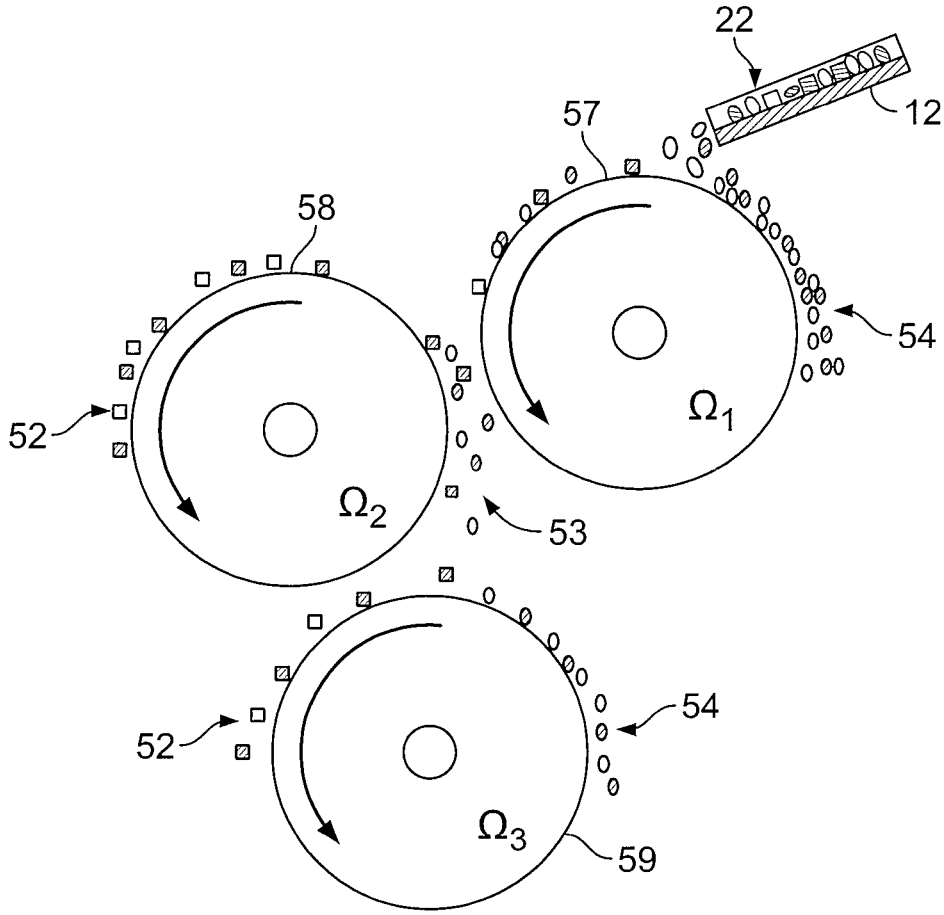
FIG. 8 shows a co-rotating Triple Forward Perpendicular Roller Separator (TFPRS).

The PRS may operate in either a forward or reverse mode, as shown in FIGS. 5 and 6 respectively. In the forward mode, higher friction materials 52 (e.g., contaminant materials) are dragged around circumferentially to be released ahead of the roller. In the reverse mode, lower friction materials 54 (e.g., non-contaminant material such as plastic flake) freely fall forward while the cylinder 56 drags the higher friction materials 52 backwards so they can fall behind the roller. The methods, systems, and devices described herein can use multiple PRS units in series. Such sequences can be useful because they may enable recovery of streams that are highly enriched in plastics (product) or contaminants (byproduct). FIG. 7 shows one possible configuration of two rollers being fed perpendicular to the axes of the rollers. The mixture is initially fed behind the centerline of the first roller 57. Therefore the lower friction materials 54, such as rigid thermoplastics, fall back towards the feed side. Higher friction materials 52, such as rubbers, are carried forward and then drop onto a second roller 58 rotating in the same direction. Lower friction materials that are initially misdirected forward to the second roller 58 drop directly down between the rollers, whereas higher friction materials 52 are propelled forward to report far from the feed end. Some of the high friction material also reports to the center with the lower friction materials, so this center stream 53 may be further processed by a second stage or re-circulated. The plastic-rich rear product and rubber-rich forward product can be highly enriched in their respective products. FIG. 8 shows a modification of the configuration in FIG. 7 and includes a third roller 59 that further separates the center stream 53 to create two enriched streams. One or more of cylinders 57, 58, and 59 can include magnetized portions to further include magnetic materials with the higher friction materials 52. Each of cylinders 57, 58, and 59 can be made of the same materials, can have a diameter of between 10 and 40 cm (e.g., between 15 and 30 cm), and can rotate at a speed of between 30 and 200 rpm (e.g., between 60 and 100 rpm).

Figure 9:
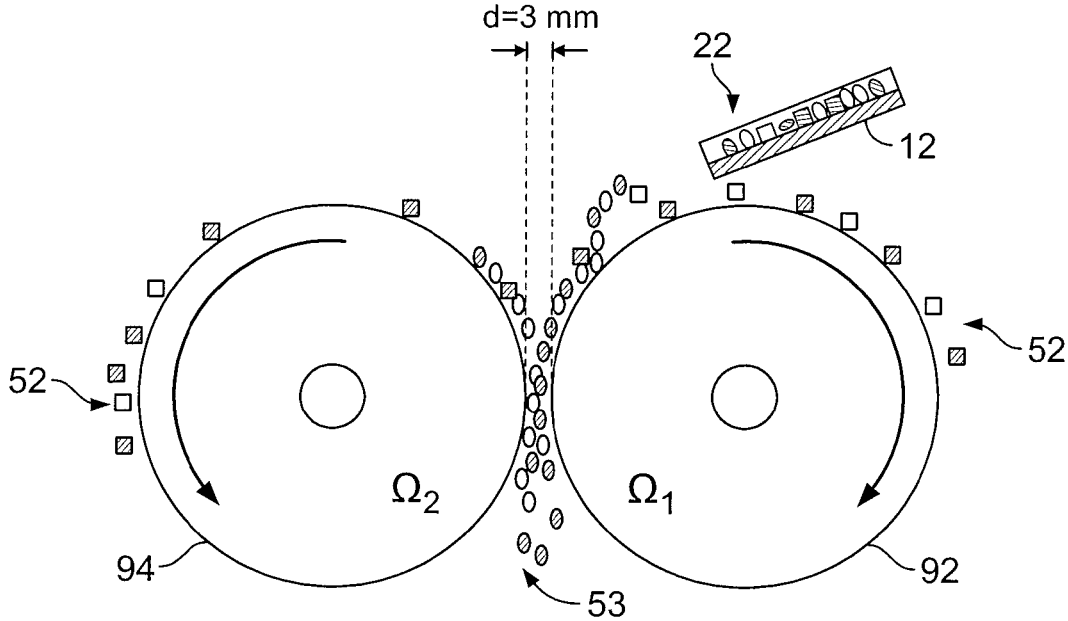
FIG. 9 shows a counter-rotating Dual Perpendicular Roller Separator (DPRS).

FIG. 9 shows a system where feed material 22 is fed to two counter-rotating cylinders 92 and 94. The rotating cylinders 92 and 94 can be made of stainless steel, nickel plated steel, or a polymer (e.g., polycarbonate, high density polyethylene, or acrylonitrile butadiene styrene). For example, a sheet of ABS or HDPE can be applied to a stainless steel shell to produce the rotating cylinders 92 and 94. The rotating cylinders 92 and 94 can have a diameter of between 10 cm and 40 cm ((e.g., between 15 and 30 cm). The rotating cylinder 56 can rotate at a rate of between 30 and 200 rpm (e.g., between 60 and 100 rpm). Frictional forces tend to drag higher friction materials 52, such as rubber, away from the center and throw it to the outer sides, whereas lower friction materials 54, such as rigid thermoplastics, will tend to fall directly though the gap between the rollers. The gap shown is about 3 mm. The gap can be adjusted to be relatively large relative to the thickness of the lower friction materials 52 (e.g., most plastic flakes), but the gap can be smaller than the larger higher friction materials 52 (e.g., bulky rubber pieces that can be about 4 mm or greater in thickness). The larger higher friction materials tend to bounce around the center for a short time until they are expelled outward due to friction. The rollers can also be tilted with respect to horizontal so that the thicker pieces slide downward along the rollers away from the feed. One or both of cylinders 92 and 94 can include magnetized portions to further include magnetic materials in flow 52.

One particular implementation of a system with counter-rotating cylinders is the roller sizer as manufactured by American International Manufacturing (Woodland, Calif.). The roller sizer, or roll sorter, is tilted at an angle of approximately 25 degrees with respect to horizontal and is fed from the upper end. The rollers of the roller sizer can be made of stainless steel, nickel plated steel, or a polymer (e.g., polycarbonate, high density polyethylene, or acrylonitrile butadiene styrene). The rollers can have a diameter of between 10 cm and 15 cm. The roller can rotate at a rate of 60-600 rpm (e.g., between about 100 and 300 rpm). The feed materials 22 slide down the sorter and are separated based on different frictional characteristics and particle thicknesses. Tuning parameters to control the sort include roller speed and the gap dimension at both lower and upper ends of the roll sorter.

Figure 10A:
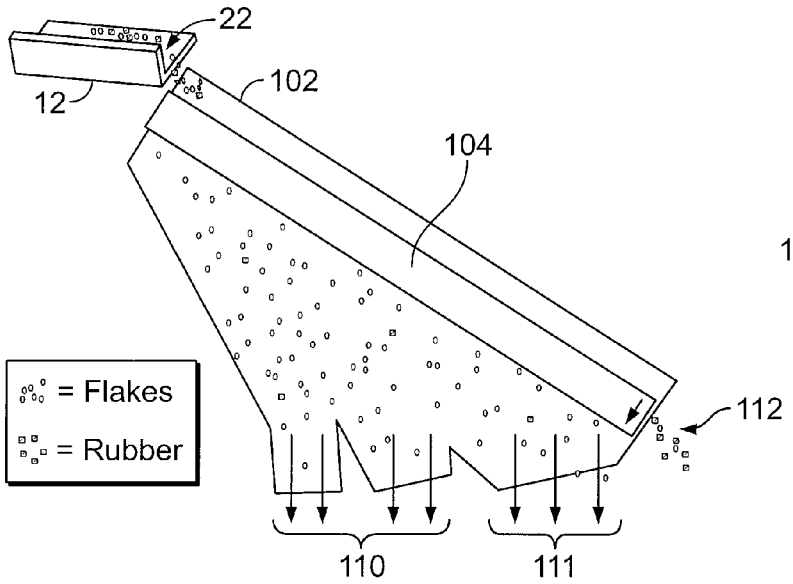
FIGS. 10A and 10B show a roll sorter which removes rubber based on frictional and bouncing characteristics.
Figure 10B:
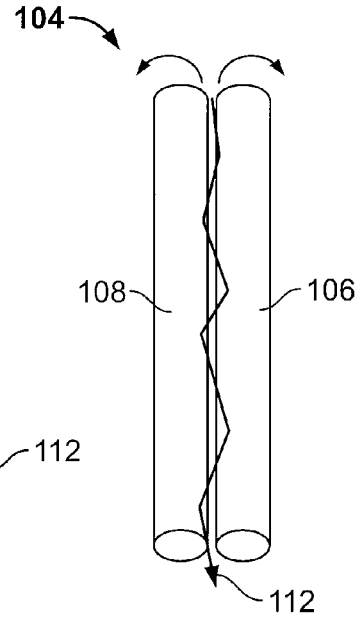

The roll sorter can be operated in two particular modes. A mode which is referred to herein as the "thick gap" mode is shown in FIGS. 10A and 10B. In this mode, the gap between rollers 104 is relatively large (e.g., between about 2 mm and 5 mm), and is larger than the thickness of the majority of the plastic particles at the outlet end. Most of the plastic flakes fall between the rollers in the "thick gap" mode and are collected as the purified product 110, whereas a significant fraction of the rubber particles are thrown slightly upwards by friction so that they then bounce down along the axis of the rollers and to a bottom byproduct outlet 112. This bottom outlet 112 also collects very thick plastic particles. Removing such particles to the byproduct can be desirable because such particles tend to be foamed or filled plastics that can reduce the properties of the product made from the purified plastic flakes. Furthermore, a middle recycle product 111 can be collected. In some embodiments of the "thick gap" mode, the rollers have a diameter of about 15 cm.

Figure 11A:
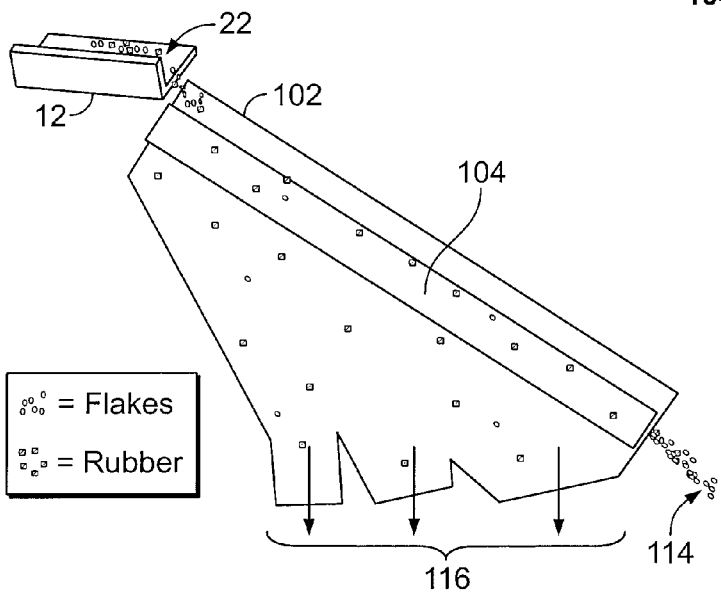
FIGS. 11A and 11B show a roll sorter which removes rubber based on frictional characteristics alone.
Figure 11B:
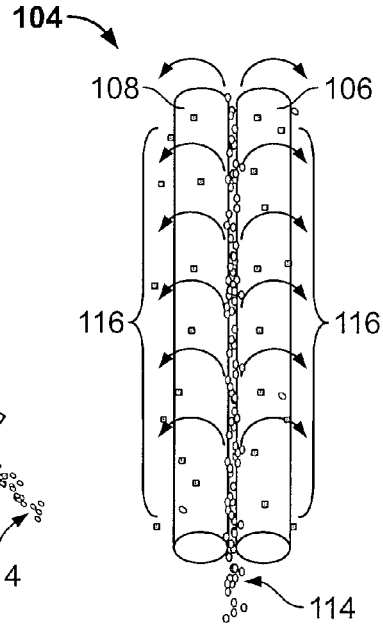
Figure 23A:
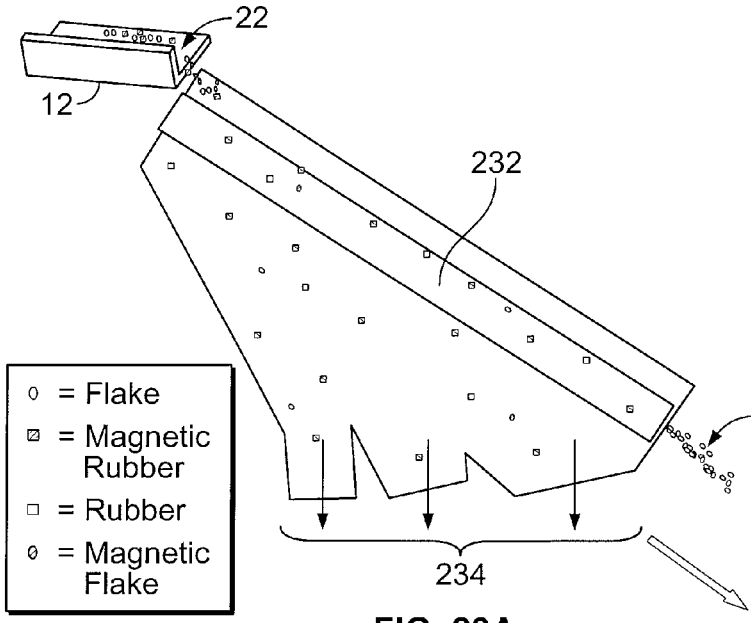
FIGS. 23A and 23B show a roll sorter which removes rubber based on frictional and magnetic characteristics.
Figure 23B:
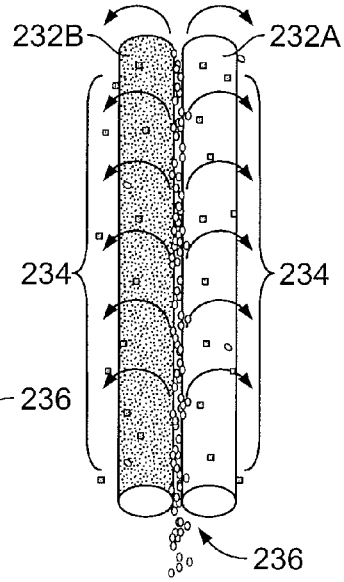

Another operating strategy for the roll sorter is a so-called "zero gap" mode. In this mode, shown in FIGS. 11A and 11B, the gap between the rollers is as small as possible. Very few particles are allowed to pass between the rollers, but the plastics and rubber mixture being conveyed down the rollers is mixed to enable many of the particles to come into contact with the rolls at some point. Higher friction materials, such as rubber, can be thrown upwards and outwards by the counter-rotating rolls, and a byproduct 116 enriched in rubber can be collected from underneath the sorter. Lower friction materials, such as plastics, tend to convey directly down the length of the rolls and exit at the far end away from the feed as a purified product 114. In some embodiments of the "zero gap" mode, the rollers have a diameter of about 10 cm. The rollers 106 and 108 can include magnetized portions to further induce magnetic materials to be included in the byproduct 116. For example, FIGS. 23A and 23B depict such a device that uses magnetic characteristics (one cylinder is magnetic and the other is non-magnetic) in addition to frictional characteristics to remove impurities from the product 236.

Figure 12:
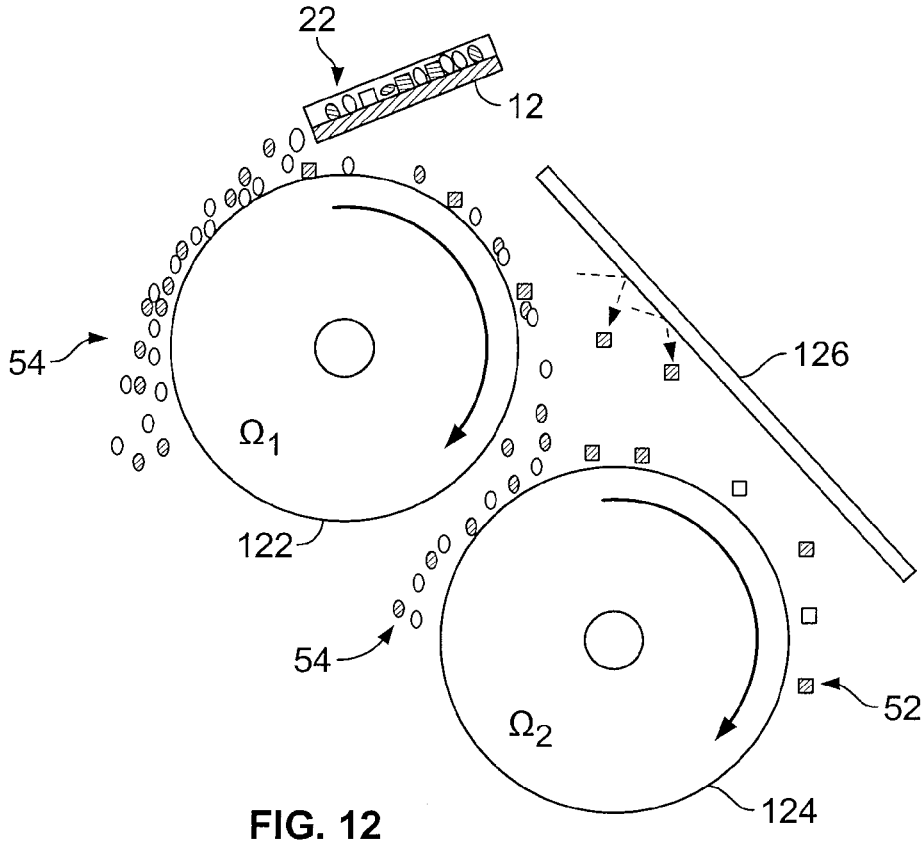
FIG. 12 shows a cascading "Scalping" Double Reverse Perpendicular Roller Separator (DRPRS).

FIG. 12 shows a two-stage separator analogous to the separator shown in FIG. 8, but with rollers 122 and 124 rotating in the opposite direction. The rollers 122 and 124 can be made of stainless steel, nickel plated steel, or a polymer (e.g., polycarbonate, high density polyethylene, or acrylonitrile butadiene styrene). The rollers 122 and 124 can have a diameter of between 10 cm and 40 cm (e.g., between 14 and 30 cm). The rollers 122 and 124 can rotate at a rate of 30-200 rpm (e.g., between 60 and 100 rpm). This device further includes a bounce control plate 126 to control the flow of bouncing materials (e.g., rubber). Such a device can enable the removal of higher friction materials 52 while achieving a high overall yield of target lower friction material 54 (e.g., plastics). The rollers 122 and 124 can include magnetized portions to further induce magnetic materials to also be removed from non-magnetic lower friction materials.

Figure 13:
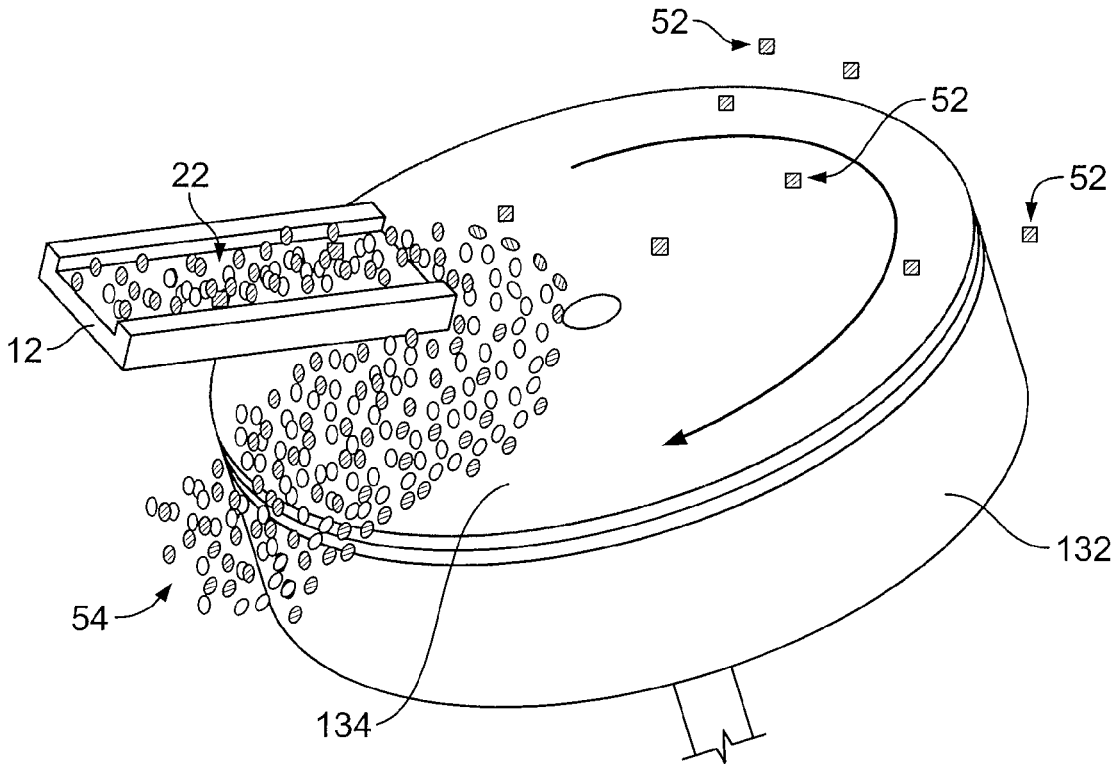
FIG. 13 shows a rotating disk used to separate plastics from contaminants using friction.
Figure 21:
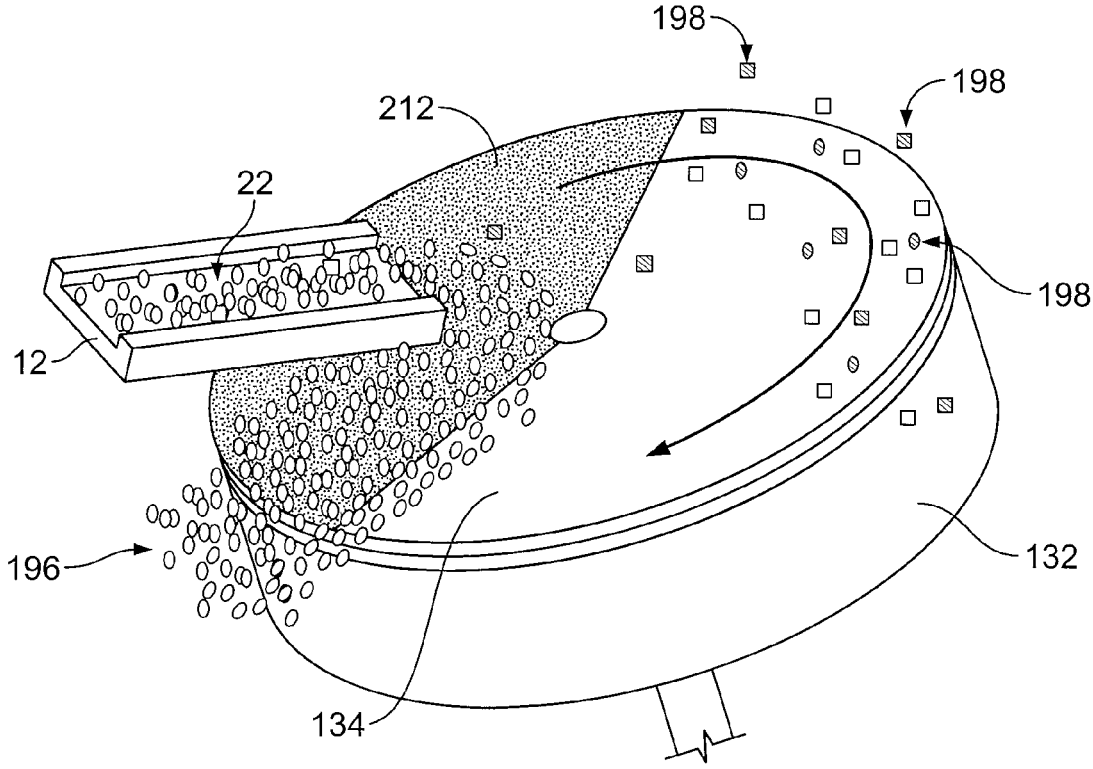
FIG. 21 shows a rotating disk over a high strength magnet. There is a magnet under the shaded quarter of the disk.

FIG. 13 shows a rotating disk 134 used to separate plastics from contaminants using friction. The rotating disk 134 can have an upper surface of stainless steel, nickel plated steel, or a polymer (e.g., polycarbonate, high density polyethylene, or acrylonitrile butadiene styrene). The rotating disk 134 can have a diameter of between 40 cm and 100 cm (e.g., about 60 cm). The rotating disk 134 can rotate at a rate of 30-100 rpm (e.g., about 60 rpm). The disk 134 is tilted at a slight angle with respect to horizontal (e.g., between 5 and 30 degrees relative to horizontal). Accordingly, the disk rotates about an axis that is not perpendicular to the direction of gravity. The end of the feeder 12 may be angled to allow a uniform gap between the feeder and the disk. The disk 134 can rotate relative to a platform 132. In other embodiments, the disk 134 can rotate with the platform 132. The higher frictional materials 52 thus move off the disk in a direction that is different than the lower friction materials 54. These directions can defined as different directions that are perpendicular to the downward slope of the rotating disk 134. In some embodiments, some portions of the platform are magnetic to result in the flow of magnetic materials in a direction different than non-magnetic and lower friction materials. For example, FIG. 21 depicts a rotating disk having a magnetic region 212 on the fixed platform 132 underneath the disk. Accordingly, both higher friction materials and magnetic materials move of the disk in a different direction than the non-magnetic and lower friction materials.

Figure 14:
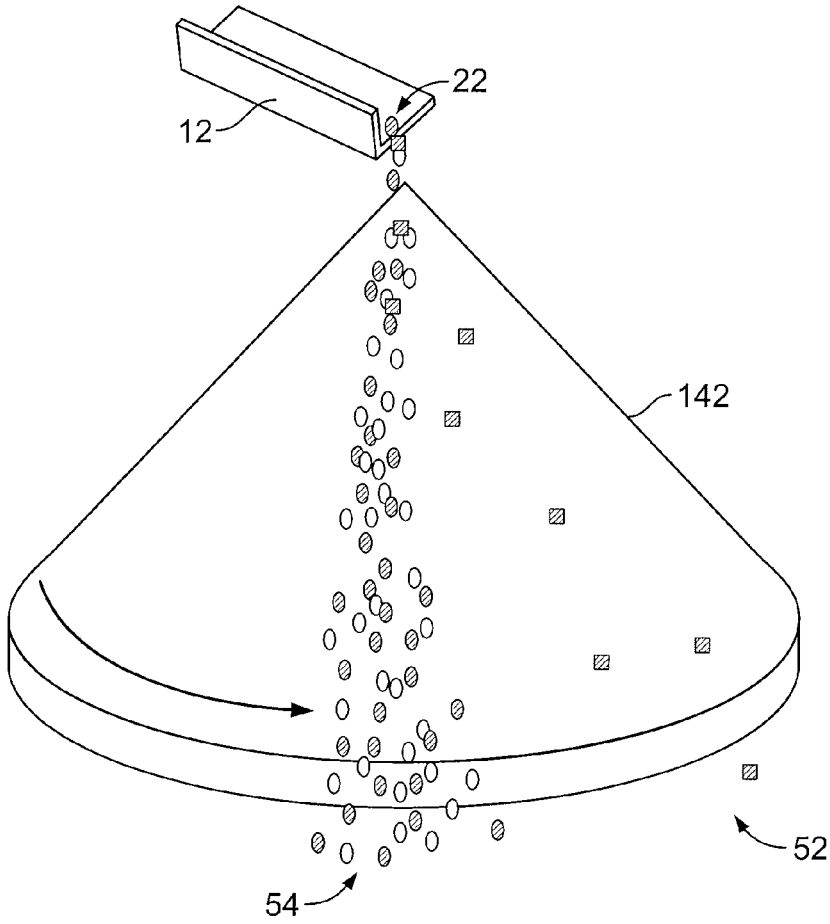
FIG. 14 shows a rotating cone used to separate plastics from contaminants using friction.
Figure 22:
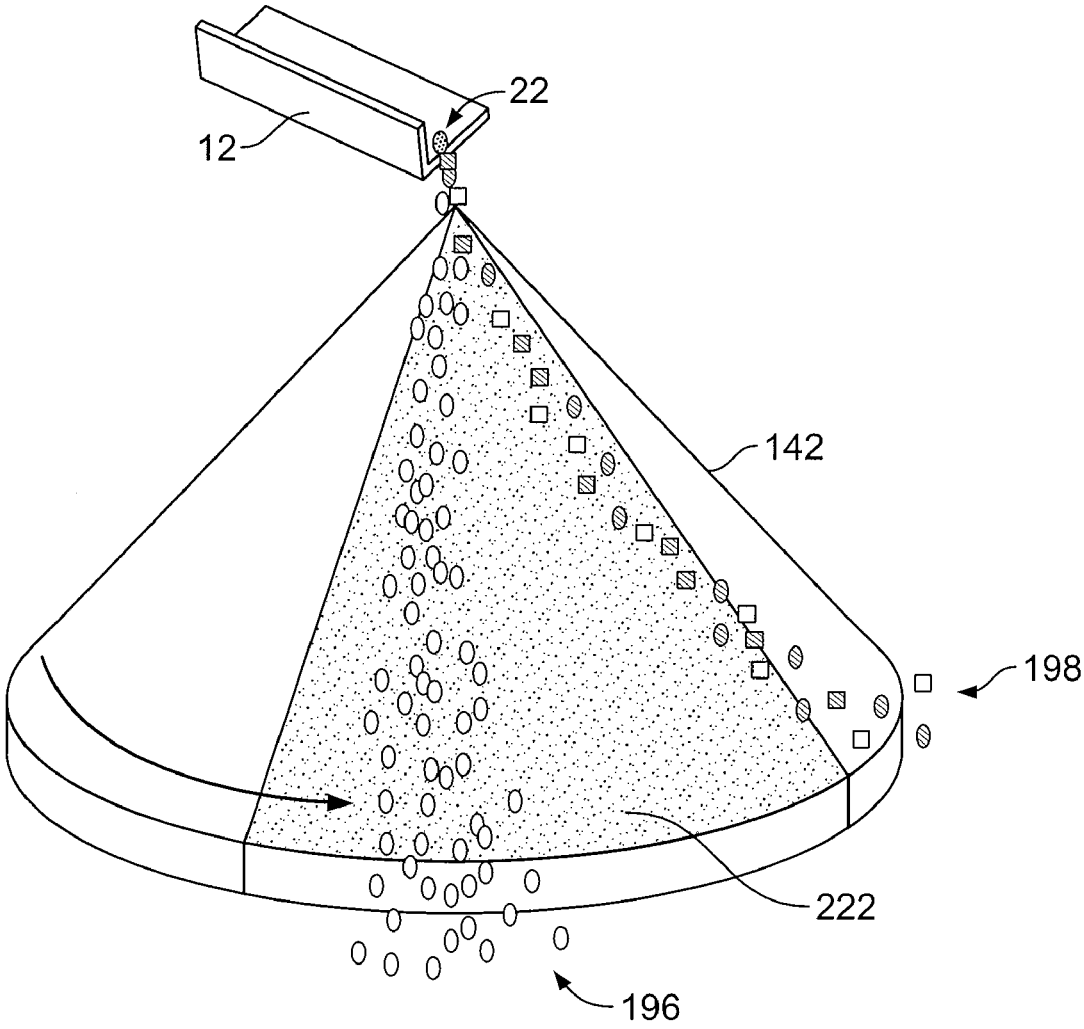
FIG. 22 shows a rotating cone over a high strength magnet. There is a magnet under the shaded section of the cone.

FIG. 14 shows a rotating cone 142 used to separate plastics from contaminants using friction. The rotating cone 142 can have an upper surface of stainless steel, nickel plated steel, or a polymer (e.g., polycarbonate, high density polyethylene, or acrylonitrile butadiene styrene). The rotating cone 142 can have a diameter of between 40 cm and 100 cm (e.g., about 60 cm) and a height of between 20 and 100 cm (e.g., about 60 cm). The cone can have a surface angle with the horizontal of about 30 to 60 degrees (e.g., about 45 degrees). The rotating cone 142 can rotate at a rate of 30-100 rpm (e.g., about 60 rpm). Feed material 22 is fed from near the top of the cone over a relatively small area. The cone rotates about an axis that is approximately parallel to the direction of gravity. Lower friction materials 54 can slide down the side of the cone with little deflection, whereas higher friction materials 52 can be deflected significantly in the direction of rotation of the cone. By careful adjustment of diverter plates near the bottom of the cone (not shown), it can be possible to separate low friction plastics from high friction contaminant materials. Accordingly, the diverter plates can allow for the separation of material based on the amount of movement of the material in a direction perpendicular to the downward slope of the cone. Furthermore, portions of the cone can be magnetized to result in a flow of magnetic materials in a direction different than the lower friction materials that are not magnetic. For example, FIG. 22 depicts a rotating cone having a fixed magnetic region 222 inside a rotating shell.

Figure 15:
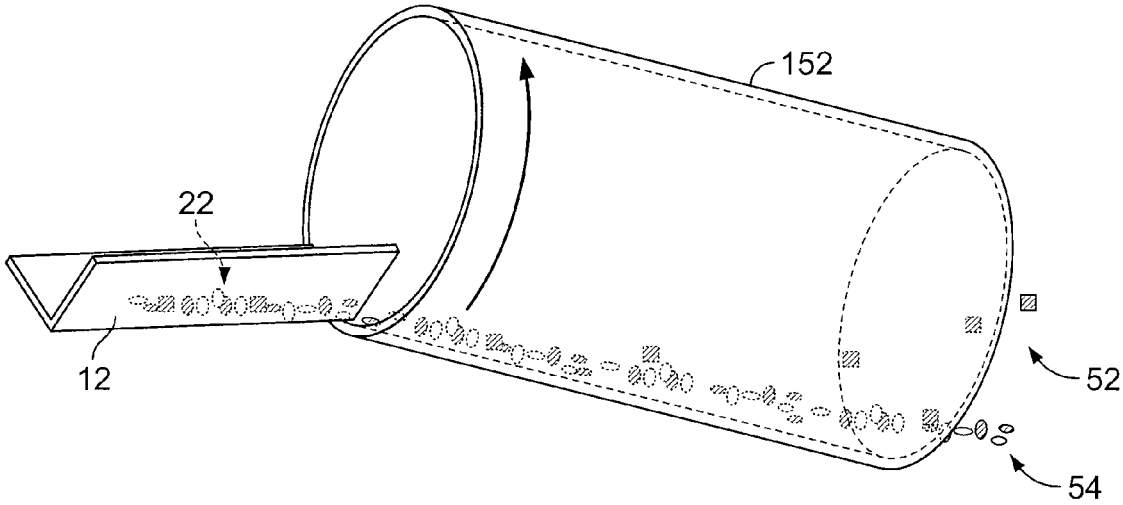
FIG. 15 shows a rotating hollow drum used to separate plastics from contaminants using friction.

FIG. 15 shows a rotating hollow drum 152 used to separate plastics from contaminants using friction. The rotating hollow drum 152 can have an inner surface of stainless steel, nickel plated steel, or a polymer (e.g., polycarbonate, high density polyethylene, or acrylonitrile butadiene styrene). The rotating hollow drum 152 can have an inner diameter of between 40 cm and 100 cm (e.g., about 60 cm) and a length of between 60 and 200 cm (e.g., about 120 cm). The drum 152 can be at an angle with the horizontal of about 5 to 30 degrees (e.g., between 10 and 20 degrees). The rotating hollow drum 152 can rotate at a rate of 30-100 rpm (e.g., about 60 rpm). Feed material 22 is fed into one end of the rotating drum. The drum 152 is slightly tilted allowing the material to slide towards the lower (product) end. Plastic flakes should slide fairly evenly down the drum, with only a slight off set due to friction. Higher friction materials 54, such as rubber, wood or fabric, on the other hand, tend to be dragged upwards with the rotating drum. The particles will slide or bounce back towards the middle once they are high enough on side of the drum such that frictional forces no longer hold them in place, but internal baffles can be installed inside the drum to collect any bouncing particles (most likely rubber). These baffles can even be vibratory conveyors to continuously remove the high friction contaminants. In some embodiments, a slotted vacuum pipe can be introduced inside the drum to suck away high friction materials in the vacuum conveying system before the high friction materials fall back into the bottom of the drum. Accordingly, the baffles, vacuum conveying system, or other features can allow for the separation of material based on the amount of movement of the material in a direction perpendicular to the downward slope of the drum 152. In some embodiments, portions of the drum 152 can be magnetized to make magnetic materials flow in a direction perpendicular to the slope of the drum 152 and thus also different than different than the lower friction materials that are not magnetic.

Figure 18:
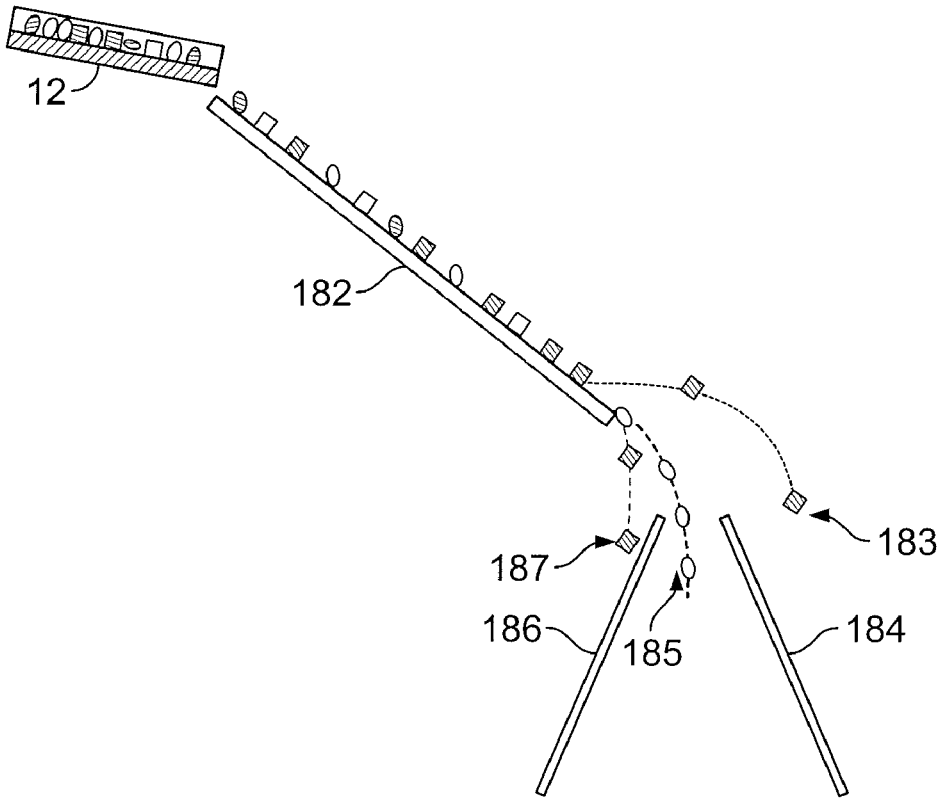
FIG. 18 shows a sliding chute where rubber is separated from plastic based on differences in dynamic friction.

Because of the different frictional characteristics of rubber and plastic, differences in how fast each material type slides down an inclined chute can be exploited. As shown in FIG. 18, lower friction materials 185 (e.g., plastic flakes) slide freely down the chute 182 and leave the chute with a relatively high velocity. The chute 182 can have a length of between 40 and 150 cm (e.g., about 80 cm), can have an angle relative to horizontal of between 35 and 75 degrees (e.g., about 60 degrees). The width of the chute will depend on the required throughput, with approximately 30 cm of width per metric ton of throughput. The chute 182 can have a surface of stainless steel, nickel plated steel, or a polymer (e.g., polycarbonate, high density polyethylene, or acrylonitrile butadiene styrene). Higher friction materials 187 (e.g., rubber) tend to slide more slowly down the chute 182 and therefore do not travel as far horizontally after leaving the chute 182. Bulky and high friction rubber pieces can tumble down the chute such that they pick up higher speed and also more horizontal component. These tumbling pieces 183 can travel even farther horizontally than plastic particles when leaving the chute 182. FIG. 18 schematically shows the trajectories of these materials and how one might include diverter plates 184 and 186 to aid in separating higher friction materials 187 and tumbling pieces 183 from lower friction materials 185. The two diverter plates 184 and 186 can be positioned such that only the lower friction materials 185, having the correct trajectory when leaving the chute 182, land between the diverter plates 184 and 186. In some embodiments, a magnet can be used to control the trajectory of magnetic materials to prevent magnetic materials from landing between the diverter plates 184 and 186 with the lower friction materials 185.

Figure 24A:
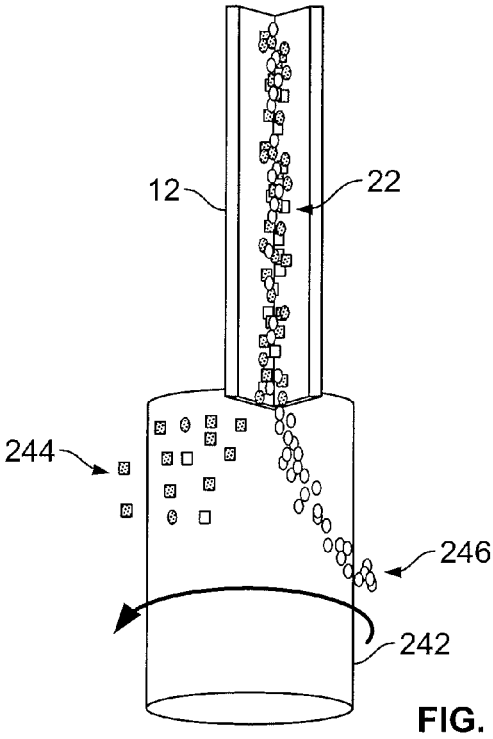
FIGS. 24A and 24B show an angled single drum sorter which removes contaminants based on differences in frictional properties.
Figure 24B:
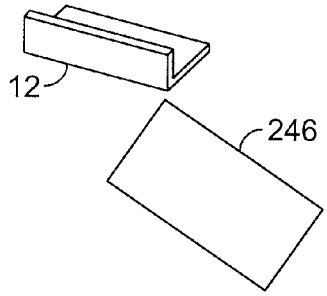

Another simple device that can be used for friction-based separation is a single drum 242 tilted at an angle and fed from the upper end of the drum. Such a device is shown in FIGS. 24A and 24B. In this case, higher friction materials 244 are pulled upwards along with the direction of drum rotation, while lower friction materials 242 easily slide off the drum 246. The drum 242 can include magnetized portions to further include magnetic materials in the flow that is pulled upwards along the direction of drum rotation. The drum 242 can be made of stainless steel, nickel plated steel, or a polymer (e.g., polycarbonate, high density polyethylene, or acrylonitrile butadiene styrene). For example, a sheet of ABS or HDPE can be applied to a stainless steel shell to produce drum 242. The drum 242 can have a diameter of between 20 cm and 40 cm (e.g., about 30 cm). The drum 242 can rotate at a rate of 20-200 rpm (e.g., between 40 and 60 rpm).

The material used for the separating surface can influence the separation performance. In particular, it may be advantageous to use materials for which the difference in dynamic friction coefficients between contaminant particles and plastic flakes is largest. Separating surfaces may be made of metals, such as carbon steel or stainless steel to simplify construction. They can also be made out of other metals, such as aluminum or brass, or they can be made of other non-metallic materials such as plastic, rubber, wood or ceramic. Surfaces can also of course be coated with paints or other surface coatings that may be of particular usefulness for aiding the separation.

The texture of the separating surface can also influence the separation performance. Textured surfaces may enhance the frictional drag on materials, and in some cases may enhance the ability of particles to tumble along the friction surface. Such textures can include, but are not limited to, directional grooves cut into the surface, mesh screen material, or perforated plate with holes smaller than the particles.

The temperature of the separating surface and of plastic-rich mixture is also important to control in order to best exploit frictional differences. At lower temperatures, materials such as rubber become more rigid, and are therefore less distinguishable from plastics in terms of frictional properties. Thus, it can be advantageous to perform separations at temperatures greater than 20 degrees Celsius.

One issue of concern in frictional separators is static charge on the particles to be separated and possibly on the surfaces themselves. Charges on the various particles and surfaces can influence how particles move and can even cause them to stick to charged surfaces. Conductive surfaces are able to dissipate charges. Thus using grounded metal materials is often desirable. Antistatic devices such as ion air blowers or air-knives can also be employed on particles and/or the frictional surface to dissipate charge.

Contaminants can also be removed by exploiting differences in both magnetic and frictional properties in a single device. Such a device are referred to as magnetofrictional separators.

Figure 20:
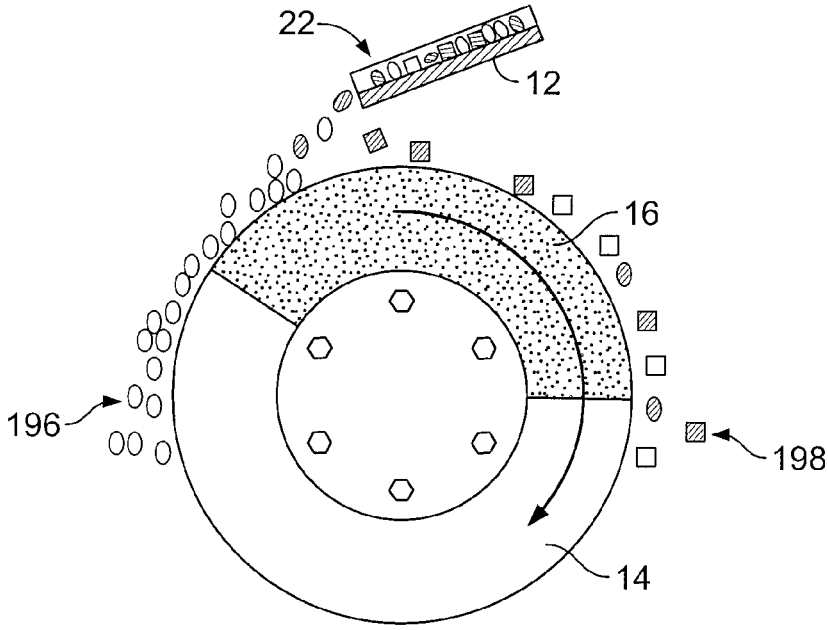
FIG. 20 shows a high strength magnetic drum in which the drum rotates in the opposite direction as the flow of feed material.

One potential magnetofrictional separation device is a magnetic drum similar to those described for purely magnetic separation, but now additionally utilizing frictional properties. Such a drum 14 can operate in either a forward or reverse mode, as shown in FIGS. 19 and 20. In the forward mode, magnetic materials attach to the drum and are dragged around circumferentially until being released somewhere beneath the magnetic drum. Also, more highly frictional materials (e.g., rubbers) can also travel with the magnetic materials to form byproduct stream 198. Because the plastic typically has lower friction against the drum surface, plastic particles will tend to slide backwards to form product stream 196. In the reverse mode, non-magnetic material freely falls forward to form product stream 196 while magnetic material attaches to the magnet and is carried backwards prior to being released behind the roller. More highly frictional materials can also travel with the magnetic materials to form byproduct stream 198. Note that these separators initially appear to be identical to the magnetic drums shown in FIGS. 1 and 2, but careful inspection of these figures and comparison with FIGS. 19 and 20 shows small differences in the feeding locations and in the direction towards which the products report. In particular, FIGS. 1, 2, and 20 have feeding locations, where the feed material 22 impacts the drum, in front of the center line, while FIG. 19 has a feeding location behind the center line.

One potential device for magnetofrictional separation is based on a rotating disk 216 with a magnet underneath 212, as shown in FIG. 21. The disk is tilted in such a way that non-magnetic and low friction particles easily slide off the disk to form product stream 196. Higher friction and/or magnetic particles, on the other hand, are carried around with the rotation and exit the disk in a different direction to form byproduct stream 198.

FIG. 22 shows a rotating cone 226 containing a magnetic section 222. Non-magnetic and low friction particles slide straight down the cone to form product stream 196. Higher friction and/or magnetic particles, on the other hand, are carried around with the rotation and slide down the cone in a different direction to form byproduct stream 198.

FIGS. 23A and 23B depict another magnetofrictional system, which includes counter-rotating rollers 232 where one of the rollers 232B contains magnets. For example, roller 232B can have a stainless steel shell having a ring of magnets within the shell, while roller 232A does not include magnets. One or both of rollers 232A and 232B can include a coating of nickel and/or a polymer (e.g., polycarbonate, high density polyethylene, or acrylonitrile butadiene styrene). Such a device can be tilted at an angle of approximately 25 degrees with respect to horizontal and is fed from the upper end. Particles slide down the sorter and are separated based on different frictional and magnetic characteristics. The rollers 232A and 232B are spaced so that few particles are allowed to slide between the cylinders (e.g., with a gap of less than 0.5 mm). Very few particles pass between the rollers, but the plastics and rubber mixture being conveyed down the rollers is mixed to enable many of the particles to come into contact with the rolls at some point. Higher friction or slightly magnetic materials, such as rubber or wood, can be thrown upwards and outwards by the counter-rotating rolls, so a byproduct 234 enriched in contaminants may be collected from underneath the sorter. Lower friction materials, such as plastics, tend to convey directly down the length of the rolls and exit as product stream 236 at the far end away from the feed. Accordingly, higher friction and magnetic materials move in a direction perpendicular to the slope of the rotating rollers while non-magnetic lower friction materials remain in the space between the rollers. Note that this separator is very similar in configuration to the roll sorter functioning in the "zero-gap" mode of FIGS. 11A and 11B and can be made of the same materials, have the same dimensions, and operate using the same conditions as those discussed for FIGS. 11A and 11B.

It is also possible to conceive of various other devices employing frictional effects in combination with magnets. These could include almost any of the rotating frictional separators but with magnets and other slight modifications.

It is also possible to employ sequences of steps of magnetic and/or frictional separation. These steps may be used in different orders depending on the exact performance of the particular separation on the particular material.

It is useful to employ both frictional and magnetic separations because some types of contaminants separate better with one method than with the other. As an example, some rubber particles tend to be easier to separate using magnets, whereas others are easier to separate based on their frictional properties.

The described methods, systems and devices can create a higher purity plastic flake mixture by enabling the removal of wood, particle board, fiberboard, cardboard, paper, film, rubber, structural foam plastic, foam, fabric, circuit boards, copper wire and metal fragments. These methods, systems, and devices can also be useful for removing painted plastics and plastics with metal coatings. In addition to contamination of the final product, the surface coatings may interfere with separation processes which rely on surface characteristics of the material. By removing such coated material, some of the plastic-plastic separation processes work more effectively and can therefore provide products that are higher in purity in terms of the plastic composition.

These methods, systems, and devices can also allow for the preferential removal of plastic flakes containing adhesives because magnetic particles stick to the adhesive. Since adhesives are often an undesirable contaminant in the final product, it is useful to remove them prior to extrusion.

An additional useful function of the magnetic separators is that they can effectively remove residual fine magnetic particles from the system. A few such magnetic particles stick on plastic surfaces after the elevated density separation, but many of these particles fall off the surfaces after abrasion in mechanical conveyance devices such as screw conveyors and pneumatic conveyors. Such particles can result in dust that coats conveyance and separation equipment. The removal of this dust by high strength magnets functions can reduce dust levels and maintain equipment at a higher level of cleanliness.

The use of high performance magnets is also effective at improving our ability to extrude the product. In addition to non-melt or poorly melting contaminants, such as wood and rubber, the melt filtration screens used in the extrusion step can also be clogged by residual magnetic particles from the elevated density separation. Since these magnetic particles can be up to around 50 or 100 microns in diameter, the presence of only a few can quickly clog melt filtration screens that typically have holes of approximately 100 microns or less. Removal of more of these residual magnetite particles prevents screen clogging and allows the extrusion to be carried out with a finer mesh screen that in turn produces plastic pellets with smaller and fewer particulate contaminants that might affect the cosmetic properties of the product.

The magnetic separators can also significantly reduce the amount of magnetic material in the final product. Some customers, especially those who commonly purchase recycled plastics, are sensitive to the presence of metal in the plastic pellets. In some cases, these customers test for metal contamination by placing a high strength magnet in a container of the pellets. Batches of product may be rejected if pellets stick to the magnet in excess of some amount specified by the customer. Because the currently described methods, systems, and devices can utilize high strength magnets, it is less likely for magnetic material to get into the product pellets. This results in a product that is more desirable to a wider range of customers.

Two or more product streams can be recovered from each separation process or a series of separation processes as a whole. Each product from the different separation processes often contains two or more types of plastics and small amounts of non-plastics. Such a product might therefore require further purification steps, as described in U.S. Patent Application Publication No. 2006/0001187. These purification steps typically include processes relying on a narrow surface to mass distribution which are preceded by surface to mass control operations. After purification of the plastics by type (and also sometimes grade), the material can be melt compounded. The flake to be melt compounded can be blended prior to extrusion in order to improve product uniformity. The melt compounding step can employ melt filtration equipment to remove most of the non-melt contaminants.

In embodiments that utilize magnets to separate magnetic materials from non-magnetic materials, the magnetic forces can be overcome due to gravity and/or centripetal forces when in operation to separate the magnetic materials from the apparatus (e.g., drum, disk, cone, roller).

EXAMPLES

The following examples demonstrate the effectiveness of high strength magnets, friction or magnets in combination with friction for the removal of contaminants from plastic-rich mixtures.

Example 1

Removal of Wood, Rubber and Metal-Coated Plastic Using a High Strength Magnet A plastic-rich flake mixture derived from shredded televisions was processed through an elevated density separation process which used a magnetite slurry for the density separation medium. The less dense product from the elevated density separation was further processed using a triboelectrostatic separator to create a high purity plastic product.

This high purity plastic product flake mixture also contained small amounts of wood, rubber and metal-coated plastic flakes. These contaminants were each present in amounts less than 1% by mass.

A hand-held high strength rare earth magnet was placed approximately 1 cm above this plastic-rich flake sample. Material that adhered to the rare earth magnet included 16% wood and 7% rubber. The remaining material consisted of plastic with embedded magnetic particulates (10%), plastic with a surface coated with fine metal or magnetite (29%) and foamed plastic with "trapped" fine metal or magnetite (37%).

No metal fragments imbedded in the wood fibers was observed, but the wood pieces were dark in color. It is therefore likely that the cause of its magnetization is the magnetite powder coating the wood surface.

Small metal fragments were embedded in the surface of the rubber particles that were removed by the hand-held high strength rare earth magnet. It is postulated that metal fragments might embed based on the relatively soft rubber surface allowing penetration of these small and rigid particles.

Example 2

Removal of Wood, Rubber, Metal-Coated Plastic, Adhesive-Coated Plastic and Magnetite Dust Using a High Strength Magnet A plastic-rich flake mixture derived from shredded refrigerators was processed through an elevated density separation process which used a magnetite slurry for the density separation medium.

A fixed high strength rare earth magnet was placed in a stream of the material while it was being fed to another plastic-plastic separation process. The flow rate of plastic-rich flake material was approximately 750 kg/hr. After 60 seconds (corresponding to 10-20 kg of flake), 26 grams of material were recovered on the rare earth magnet (approximately 0.2% of the feed). The composition of this recovered material included 73% plastic with metallic coating (paint or plating), 11% plastic with a sticky surface (residual foam and/or adhesive), 8% rubber or wood, and 8% magnetic dust. The magnetic dust was primarily magnetite.

Example 3

Mechanical Incorporation of Magnetite

A hand-held rare earth magnet was used to obtain magnetite-rich dust from a location in the process after the elevated density separation.

A hand-held high strength rare earth magnet was passed over a sample of plastic-rich flake material derived from electronics waste. The flakes were approximately 8 mm or less in size. A very small portion of the sample was picked up by the magnet. The pieces that were picked up consisted mainly of plastics with embedded metal chips, stainless steel, and fluff.

Several pieces of plastic, wood and rubber were selected from the same sample of plastic-rich flake material derived from electronics waste. The pieces of wood, rubber, and plastic selected from the sample pile were pieces that were not initially attracted to the magnet.

The plastic, wood, and rubber pieces were combined with approximately 20 g of the magnetic dust in a small plastic bag. The bag was shaken vigorously for about 1 minute. It was then placed on the floor and stepped on once. The test pieces and dust from the plastic bag were then poured onto a paper sheet. The paper sheet was then shaken to allow the magnetite-rich dust settle to the bottom of the pile and to help singulate the pieces. The test pieces were then dropped from a height of approximately 8 cm onto a hard surface to liberate any residual magnetic dust. The plastic flake bounced the hardest and became dust free, while the rubber bounced much less and the wood barely bounced at all.

A hand-held rare earth magnet was then placed close to test pieces and the pieces were separated into those that stick to the magnet (M1) from those that do not stick (N1). The separated pieces were then counted.

The non-magnetic N1 pieces were then combined with a magnetite dust that was finer than that used in the first mixing step described above. The sequence of shaking the sample in the bag, stepping on the sample bag, shaking the sample on a piece of paper and dropping the pieces was then repeated on the N1 pieces with the finer magnetite.

A hand-held rare earth magnet was then placed close to treated N1 test pieces and the pieces were separated into those that stick to the magnet (M2) from those that do not stick (N2). The separated pieces were then counted.

Figure 4:
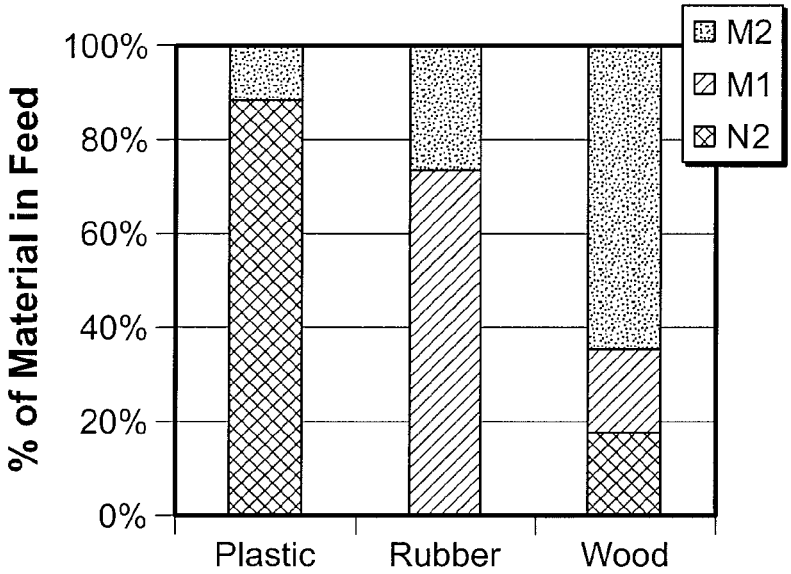
FIG. 4 shows the separation of materials with a high performance magnet (% to each product stream).

The data for this trial are summarized in Table 1 and FIG. 4. All of the flake particles are non-magnetic in the first pass, but three of the 26 are magnetic in the second pass with the rare earth magnet. Most of the rubber is removed in the first pass (11 of 15 pieces), and the remaining 4 pieces are removed in the second pass. Only 3 of the 17 wood pieces are removed in the first pass, but 11 of the remaining 14 are removed in the second pass.

TABLE 1

Separation of Materials with a High Strength Magnet (# of pieces in each stream)

| stream | flake | rubber | wood |
|---|---|---|---|
| feed | 26 | 15 | 17 |
| N1 (first pass product) | 26 | 4 | 14 |
| M1 (reject 1) | 0 | 11 | 3 |
| N2 (product) | 23 | 0 | 3 |
| M2 (reject 2) | 3 | 4 | 11 |

The results of this simple trial indicate that a high strength magnet can be effective at removing both rubber and wood from plastics after the mixture has been combined with magnetic dust such as magnetite. The trials also demonstrate that there are some critical considerations for optimizing this sort of process. The three keys to making this viable are magnetite particle size, the mechanics of mixing and the liberation of dust.

Finer magnetite dust added to the mixture enabled the high strength magnet to remove nearly all of the contaminants (i.e., rubber and wood) that remained after the first pass with coarser magnetite.

Apply a fairly large force to the mixture (e.g., stepping on the bag) ensures that magnetite dust is embedded into the wood and rubber. In industrial practice, such a force could be imparted using a screw conveyor at high loading, for example.

In order to have different magnetic properties for the different types of materials, it was important to liberate the magnetite dust from the particles. In this example, dropping the material approximately 8 cm was sufficient for liberating much of the dust clinging to the surface.

Example 4

Multi-Stage Processing of Plastic-Rich Material Using a Rare Earth Drum Magnet The starting material for this example was a plastics-rich mixture recovered from Waste Electronics and Electronics Equipment (WEEE). The mixture had been sorted by density at 1.0 and at approximately 1.1. The elevated density sort was accomplished using a hydrocyclone with magnetite as a dense medium.

The material was processed over a rare earth drum magnet. The nominal magnetism of the magnet was 7000 gauss. The diameter of the drum was 24 inches (60 cm). The non-magnetic material from the first pass was processed over the magnet a second time.

Table 2 shows the yield and compositions of the feed, non-magnetic product and magnetic byproducts. The magnetic byproducts are enriched in rubber, wood, foam/fluff and fines (i.e., smaller than 3.2 mm).

TABLE 2

Yields and compositions of feed and product streams for rare earth drum magnet separation of plastic-rich material

| | feed | Non-magnetic product | Magnetic byprod. (pass 1) | Magnetic byprod. (pass 2) |
|---|---|---|---|---|
| yield | 100% | 97.9% | 1.6% | 0.5% |
| plastics | 95.7% | 95.7% | 76.5% | 83.1% |
| rubber | 0.44% | 0.3% | 4.6% | 4.8% |
| wood | 0.04% | 0.0% | 2.6% | 0.0% |
| foam/fluff | 0.01% | 0.0% | 1.0% | 0.3% |
| fines | 3.8% | 4.0% | 15.4% | 11.8% |

Example 5

Multi-Stage Processing of Plastic-Rich Material Using a Rare Earth Roller Magnet The starting material for this example was a plastics-rich mixture recovered from Waste Electronics and Electronics Equipment (WEEE). The mixture had been sorted by density at 1.0 and at approximately 1.1. The elevated density sort was accomplished using a hydrocyclone with magnetite as a dense medium.

Figure 3:
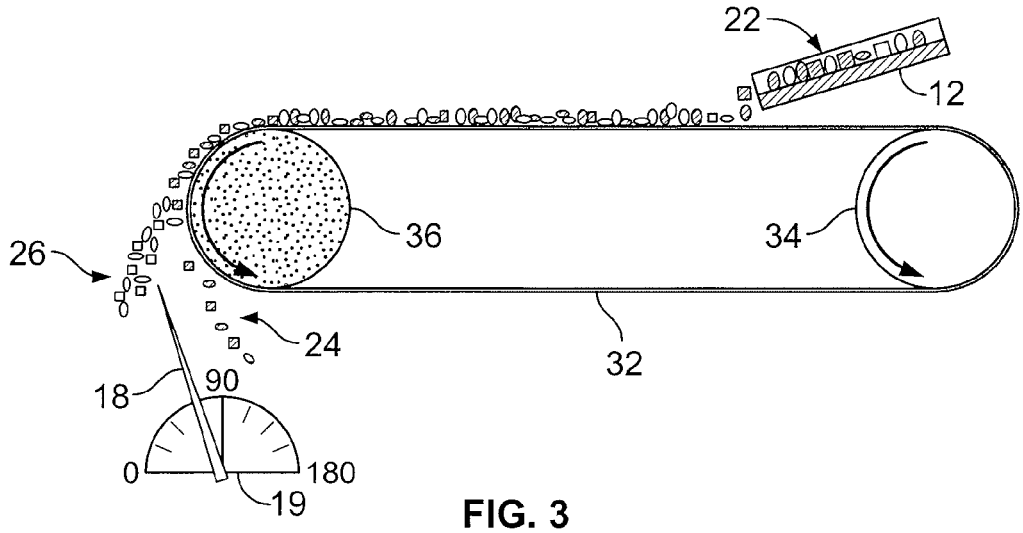
FIG. 3 shows a high strength roller magnet.

The material described in Example 4 was separately processed over a rare earth roller magnet as shown schematically in FIG. 3. The nominal magnetism of the magnet was 21000 gauss. The diameter of the magnetic pulley was 4 inches (10 cm). The material was conveyed along a Kevlar belt with a thickness of 0.25 mm. The non-magnetic material from the first pass was processed over the magnet a second time.

Table 3 shows the yield and compositions of the feed, non-magnetic product and magnetic byproducts. The magnetic byproducts are enriched in rubber, wood, foam/fluff and fines (i.e., smaller than 3.2 mm).

TABLE 3

Yields and compositions of feed and product streams for rare earth roller magnet separation of plastic-rich material

| | feed | Non-magnetic product | Magnetic byprod. (pass 1) | Magnetic byprod. (pass 2) |
|---|---|---|---|---|
| yield | 100% | 88.7% | 9.4% | 2.0% |
| plastics | 95.7% | 97.1% | 86.2% | 93.4% |
| rubber | 0.44% | 0.28% | 1.8% | 1.2% |
| wood | 0.04% | 0.0% | 0.3% | 0.0% |
| foam/fluff | 0.01% | 0.0% | 0.1% | 0.0% |
| fines | 3.8% | 2.6% | 11.4% | 5.3% |

Example 6

Separation of Large Rubber and Plastic Particles Derived from Automotive Shredder Residue The starting material for this trial was a 50/50 mixture (by weight) of black plastic and rubber. The particles had been picked by hand from automotive shredder residue (ASR) and had been granulated to under approximately 25 mm.

Figure 16:
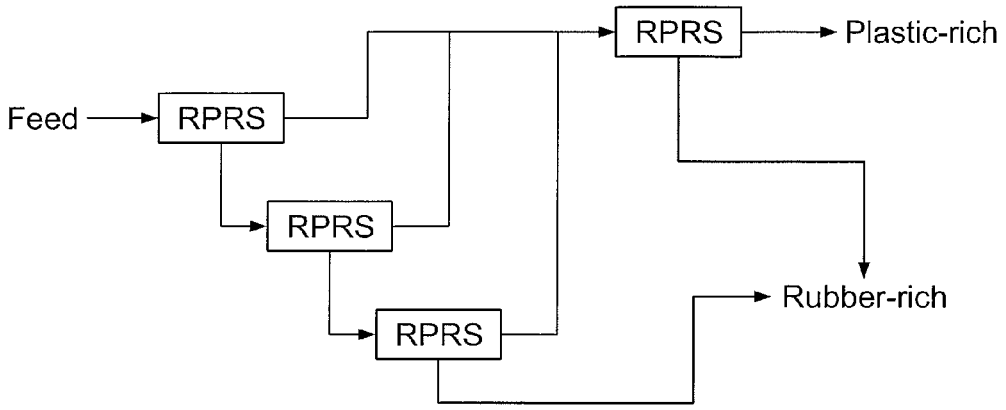
FIG. 16 shows a strategy to create plastic-rich and rubber-rich products (rubber-rich shown down and plastic-rich to the right of each RPRS).

A perpendicular roller separator was used in "reverse mode" (RPRS), as shown in FIG. 6. In processing the feed mixture in the RPRS, the first pass yielded a plastic-rich product and a rubber-rich product also contained a significant amount of plastic. The rubber-rich and plastic-rich streams were processed a number of times using the strategy shown in FIG. 16.

During the processing, pieces of the mixture containing fibrous material were easily taken backwards towards the rubber-rich stream. A significant fraction of rubber was in the "reverse" stream. The reverse stream also contained a few pieces of thin plastic that likely had significant frictional surface contact with the roller. Many thicker pieces of rubber hit the roller and bounced high in the air in seemingly random directions. Some of this rubber bounced out of the separator and spilled onto the floor. Table 4 shows the yields and approximate compositions of the plastic-rich product, the rubber-rich reject, and the material that spilled out of the RPRS.

TABLE 4

Yields and Approximate Compositions of the RPRS Products

| | plastic-rich | rubber-rich | spillage |
|---|---|---|---|
| Yield | 35.6% | 58.8% | 5.6% |
| Plastic content (approx.) | 90% | 30% | <10% |

Example 7

Separation of Rubber from Plastic Using the Forward Perpendicular Roller Separator The feed material for this trial was a mixture of plastic flakes derived from refrigerators with rubber particles. The size of the plastic and rubber particles was approximately 8 mm or less.

Rubber tended to concentrate in the forward stream, as expected, whereas the rubber content of the reverse stream was reduced.

Example 8

Separation of Small Rubber and Plastics Particles Derived from Automotive Shredder Residue The forward perpendicular roller separator (FPRS) was tested using a plastic-rich flake mixture recovered from automotive shredder residue (ASR). The mixture, which contained particles smaller than about 8 mm, contained about 0.1% or less rubber.

After the first pass through the FPRS, the plastic-enriched product was depleted in rubber while the reject contained a small but noticeable fraction of rubber. This reject was further processed through the system, and then processed that reject through the system in a third pass. At each stage, almost no rubber was in the product but a gradual enrichment of rubber in the reject. This result suggests the potential effectiveness of using multiple PRS units in series.

Example 9

Multiple Stages of PRS (Reverse Mode) to Remove Contaminants from WEEE Plastics The feed material used in this example consisted of particles smaller than about 8 mm in size. The mixture was derived from waste electronics and electronics equipment (WEEE) from a European source.

Figure 17:
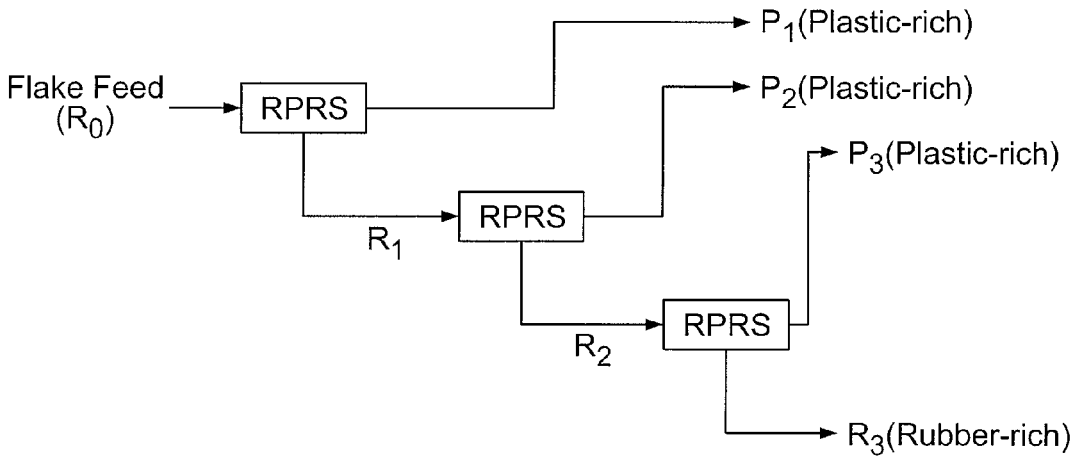
FIG. 17 shows a strategy to create plastic-rich and rubber-rich products from RPRS.

The mixture was processed in "reverse mode" (RPRS), applying multiple stages to create plastic-rich and rubber-rich products. The process strategy is shown in FIG. 17. The reject stream from the first RPRS stage ($R_1$) is processed in a second RPRS stage, and the reject stream from the second RPRS stage ($R_2$) is processed in a third RPRS stage to create a product that is enriched in rubber and other contaminants. The products from each stage ($P_i$) are depleted in contaminants and can be combined to create a plastic-rich product. The three product streams ($P_1$+$P_2$+$P_3$) are 99.5% of the feed, with only 0.5% of the feed ending up in the reject stream $R_3$.

The compositions of the various streams are given in Table 5. The reject streams are greatly enriched in rubber and fines. In addition, components (e.g. foam, wood and fabric) that were not observed in the feed were found in the contaminant-enriched reject stream.

TABLE 5

Yields and Compositions of RPRS Product and Reject streams

| material type | feed | $P_1$ | $R_1$ | $P_2$ | $R_2$ | $P_3$ | $R_3$ |
|---|---|---|---|---|---|---|---|
| plastic | 95.8% | 98.3% | 88.5% | 90.9% | 69.1% | 81.5% | 45.9% |
| foam | 0.0% | 0.0% | 0.0% | 0.0% | 0.3% | 0.0% | 0.2% |
| rubber | 1.1% | 0.2% | 2.2% | 1.2% | 9.4% | 4.1% | 26.3% |
| wood | 0.0% | 0.0% | 0.0% | 0.1% | 0.7% | 0.0% | 0.4% |
| fabric | 0.0% | 0.0% | 0.0% | 0.0% | 0.0% | 0.0% | 0.2% |
| fines (<⅛") | 3.1% | 1.5% | 9.2% | 7.8% | 20.6% | 14.3% | 27.1% |

Example 10

Roll Sorter in "Thick Gap" Mode

A material derived from waste electronics and electronics equipment (WEEE) was processed using a roll sorter in "thick gap" mode. The diameter of the rollers was four inches and the length was thirty inches. The gap at the upper end of this sorter was approximately four millimeters, and the gap at the lower end was approximately six millimeters. The rollers rotated at approximately 150 revolutions per minute. The roll sorter was fed at approximately 220 kg/hr.

Table 6 shows the yield and compositions of the feed and product streams, as well as an intermediate "medium" stream that would likely be re-run to maintain a reasonably high yield. These results clearly show that rubber concentrates in the thicker streams and is depleted in the thinner streams.

TABLE 6

Yields and Compositions of Roll Sorter streams using the "Thick Gap" Mode

| | feed | product | medium | thick BP |
|---|---|---|---|---|
| yield | 100% | 63.1% | 36.2% | 0.8% |
| plastics | 95.7% | 95.0% | 96.9% | 93.8% |

TABLE 6-continued

Yields and Compositions of Roll Sorter streams using the "Thick Gap" Mode

| | feed | product | medium | thick BP |
|---|---|---|---|---|
| rubber | 0.44% | 0.27% | 0.67% | 3.7% |
| fines | 3.8% | 4.6% | 2.4% | 2.5% |

Example 11

Roll Sorter in Zero Gap Mode

A material derived from waste electronics and electronics equipment (WEEE) was processed using a roll sorter in "zero gap" mode. The diameter of the rollers was four inches and the length was thirty inches. The gaps at the upper and lower ends of this sorter were both approximately one millimeter. The rollers rotated at approximately 600 revolutions per minute. The roll sorter was fed at approximately 220 kg/hr.

Table 7 shows the yield and compositions of the feed and product streams. These results clearly show that rubber concentrates in the byproduct stream that has bounced out to the sides and is depleted in the product stream exiting at the end.

TABLE 7

Yields and Compositions of Roll Sorter streams using the "Zero Gap" Mode

| | feed | product | byproduct |
|---|---|---|---|
| yield | 100% | 97.3% | 2.7% |
| plastics | 95.7% | 95.9% | 87.2% |
| rubber | 0.44% | 0.19% | 9.3% |
| fines | 3.8% | 3.8% | 3.4% |

Example 12

Sliding Chute Sorter

A material derived from waste electronics and electronics equipment (WEEE) was processed by allowing it to slide down a steel plate that was two feet in length. The plate was at an angle of 25 degrees with respect to horizontal. The material was sorted as shown in FIG. 18, but only the "slow sliding" rear byproduct and "free sliding" forward product were collected. The yields and compositions of the feed and product streams are given in Table 8. A significant fraction of the rubber reported to the rear byproduct stream.

TABLE 8

Yields and Compositions of Slide Sorter processing WEEE material

| | Feed | Forward product | Rear byproduct |
|---|---|---|---|
| yield | 100% | 93.6% | 6.4% |
| Fines | 1.3% | 1.3% | 1.3% |
| Plastics | 98.4% | 98.5% | 96.2% |
| Rubber | 0.32% | 0.19% | 2.32% |
| Wood | 0.01% | 0.01% | 0.09% |
| other | 0.0% | 0.0% | 0.05% |

Example 13

Sliding Chute Sorter with Different Materials

A material derived from waste electronics and electronics equipment (WEEE) was processed by allowing it to slide down surface that was four feet in length. The plate was at an angle of 25 degrees with respect to horizontal. The material was sorted as shown in FIG. 18. The "slow sliding" rear stream and "bouncing" far forward streams were counted as byproducts. The "free sliding" middle stream was collected as the product.

Various materials with different frictional properties were used as the slide surface to determine the effects on sorting. The surface materials used were metal, wood (pine), plastic (polycarbonate) and rubber.

Table 9 shows the results for the different surface materials. The friction in the rubber surface slide was so high that no separation was achieved so it is not presented in Table 9. The composition of the feed for each test varied slightly, so it is difficult to define which surface is best. The polycarbonate surface was best at concentrating rubber in the byproduct stream, whereas metal was the worst material (of the three in the table) for this purpose.

TABLE 9

Yields and Compositions of Slide Sorter processing WEEE material with different material surfaces

| | Metal | Polycarbonate | Wood (pine) |
|---|---|---|---|
| Product yield | 81.28% | 79.45% | 88.23% |
| % rubber in product | 0.26% | 0.64% | 0.55% |
| % rubber in byproduct | 0.97% | 2.78% | 1.85% |
| % fines in product | 2.21% | 1.92% | 2.32% |
| % fines in byproduct | 2.63% | 4.07% | 2.54% |

TABLE 9-continued

Yields and Compositions of Slide Sorter processing WEEE material with different material surfaces

| | Metal | Polycarbonate | Wood (pine) |
|---|---|---|---|
| % wood in product | 0.00% | 0.07% | 0.01% |
| % wood in byproduct | 0.02% | 0.18% | 0.03% |

Example 14

Single Roll Frictional Sorter

A material derived from waste electronics and electronics equipment (WEEE) was processed using a single roll frictional sorter as shown in FIGS. 24A and 24B. The technique uses friction as the sorting mechanism. The material is poured on the roll away from its apex in such a way that gravity pours the material against the rotation of the roll. Material with higher friction is dragged by the roll and thrown to the byproduct side while the lower friction material simply slides off the drum. Table 10 shows the result for one of the runs using the single roll sorter technique with high density polyethylene as the surface material.

TABLE 10

Yields and Compositions of Single Roll Sorter processing WEEE material

| | Feed | Low friction product | High friction byproduct |
|---|---|---|---|
| yield | 100% | 81.6% | 18.4% |
| Fines | 2.645% | 2.12% | 4.96% |
| Plastics | 96.796% | 97.6% | 93.24% |
| Rubber | 0.501% | 0.24% | 1.65% |
| Wood | 0.025% | 0.02% | 0.05% |
| other | 0.003% | 0.0% | 0.01% |

Example 15

Multi-Pass Separation with Magneto-Frictional PRS

A mixture of flakes recovered from WEEE was processed over a forward rotating magneto-frictional sorter such as and the one shown in FIG. 19. The non-magnetic and/or low friction product from each pass was processed multiple times.

Table 11 shows the overall yields, compositions and fractions of total rubber in the feed reporting to the product and reject streams. These results show a good concentration of rubber in the reject streams. Note that the amount of rubber removed decreases for each pass, yet remains significant even for the fifth pass.

TABLE 11

Five passes Magneto-Frictional Sorter results for WEEE material

| | | | Rejects | | | | | |
|---|---|---|---|---|---|---|---|---|
| | Feed | Product | 1 | 2 | 3 | 4 | 5 | Total |
| Percent Yield | 100% | 95.3% | 1.4% | 1.0% | 0.8% | 0.7% | 0.7% | 4.7% |
| Percent Rubber | 0.55% | 0.15% | 9.2% | 10.3% | 9.2% | 8.8% | 5.3% | 8.8% |
| Fraction of Total Rubber | 1.000 | 0.255 | 0.230 | 0.195 | 0.134 | 0.118 | 0.068 | 0.745 |

Example 16

Multi-Pass Separation with Magneto-Frictional PRS

A mixture of flakes recovered from automotive shredder residue (ASR) was processed over a forward rotating magneto-frictional sorter such as described in Example 15 and as shown in FIG. 19.

Table 12 shows the overall yields, compositions and fractions of total rubber in the feed reporting to the product and reject streams. These results show a good concentration of rubber in the reject streams. Note that the amount of rubber removed decreases for each pass, especially after the second pass, yet remains significant even for the fifth pass.

TABLE 12

Five passes Magneto-Frictional Sorter results for ASR material

| | | | Rejects | | | | | |
|---|---|---|---|---|---|---|---|---|
| | Feed | Product | 1 | 2 | 3 | 4 | 5 | Total |
| Percent Yield | 100% | 85.9% | 8.3% | 2.9% | 1.2% | 0.8% | 0.89% | 14.1% |
| Percent Rubber | 5.72% | 1.36% | 32.2% | 39.2% | 26.4% | 25.1% | 25.8% | 32.4% |
| Fraction of Total Rubber | 1.000 | 0.205 | 0.465 | 0.200 | 0.055 | 0.037 | 0.039 | 0.795 |

Example 17

Multi-Pass Separation with Rare Earth Magnet Drum and Magneto-Frictional PRS

A mixture of flakes recovered from WEEE was processed once over a rare earth magnet as shown in FIG. 1. The non-magnetic product was then processed four times over a forward rotating magneto-frictional sorter such as shown in FIG. 19.

Table 13 shows the overall yields, compositions and fractions of total rubber in the feed reporting to the product and reject streams. These results show a good concentration of rubber in the reject streams. Note that the amount of rubber removed decreases for each pass, especially after the second pass, yet remains significant even for the fifth pass.

TABLE 13

Five passes including rare earth magnet drum followed by Magneto-Frictional Sorter for WEEE material

| | | | Rejects | | | | | |
|---|---|---|---|---|---|---|---|---|
| | Feed | Product | 1 REM | 2 MFS | 3 MFS | 4 MFS | 5 MFS | Total |
| Percent Yield | 100% | 94.1% | 3.5% | 0.7% | 0.7% | 0.5% | 0.5% | 5.9% |
| Percent Rubber | 0.51% | 0.11% | 5.4% | 11.0% | 9.7% | 8.1% | 6.8% | 6.91% |
| Fraction of Total Rubber | 1.000 | 0.210 | 0.364 | 0.154 | 0.127 | 0.080 | 0.064 | 0.790 |

We claim:

1. A method for separating a mixture of pieces of solid materials, wherein the pieces comprise thermoplastic flakes and one or more components selected from the group consisting of rubber, polymeric foam, textile fragments, and combinations thereof, wherein the thermoplastic flakes have a lower coefficient of friction than the one or more components, the method comprising:

incorporating a ferromagnetic particulate material into the mixture of pieces of solid materials, the ferromagnetic particulate material preferentially incorporating into or adhering to the one or more components as compared to the thermoplastic flakes, wherein, after the incorporating step, the one or more components have different magnetic properties; and after the incorporating step, separating the mixture of pieces of solid materials into at least two groups by directing the mixture against at least one surface having a magnetized portion such that each piece travels along two or more paths, wherein pieces of the mixture of solid materials are urged to travel in a first direction based on magnetic forces due to the magnetic properties of each piece and also based on frictional forces due to the frictional properties of each piece, but urged to travel in a second direction based on gravitational forces, such that the one or more components are separated from the thermoplastic flakes due to a combination of each piece's magnetic properties and frictional properties.

2. The method of claim 1, wherein the separating includes forming a stream of the mixture of pieces of solid materials and directing the stream toward a rotating cylinder, the rotating cylinder including a magnet located within a rotating cylinder to create the magnetized portion, which is on an outer surface of the rotating cylinder, the rotating cylinder being oriented perpendicular to a direction of the stream of the mixture of pieces of solid materials.

3. The method of claim 1, wherein the separating includes forming a stream of the mixture of pieces of solid materials and directing the stream toward an inclined rotating planar surface, the rotating planar surface including a magnet located under the inclined rotating planar surface to create a magnetized portion of the rotating planer surface, wherein the stream of the mixture of pieces of solid materials is directed to make contact with the magnetized portion of the rotating planar surface.

4. The method of claim 1, wherein the separating includes forming a stream of the mixture of pieces of solid materials and directing the stream toward a rotating cone, the rotating cone including a magnet located under the inclined rotating planar surface to create a magnetized portion of the rotating cone.

5. The method of claim 1, wherein the magnetized portion is created by a neodymium-iron-boron rare earth magnet.

6. The method of claim 1, wherein the incorporating step includes mechanical action that preferentially embeds ferromagnetic particulate material in some components of the mixture of pieces of solid materials, the mechanical action selected from the group consisting of a size reduction process, a material handling step, an elevated density separation step, and combinations thereof.

7. The method of claim 1, wherein the pieces are particles having a size of between about 2 mm and about 10 mm.

8. The method of claim 1, wherein incorporating the ferromagnetic particulate material into the mixture of pieces of solid materials is part of a process of separating at least a portion of the mixture into at least two groups based on the density of the different pieces of the mixture after the incorporation of the ferromagnetic particulate material.

9. A method for separating a mixture of pieces of solid materials, wherein the pieces comprise thermoplastic flakes and one or more components selected from the group consisting of rubber, polymeric foam, textile fragments, and combinations thereof, wherein the thermoplastic flakes have a lower coefficient of friction than the one or more components, the method comprising:

incorporating a ferromagnetic particulate material into the mixture of pieces of solid materials, the ferromagnetic particulate material preferentially incorporating into or adhering to the one or more components as compared to the thermoplastic flakes, wherein, after the incorporating step, the one or more components have different magnetic properties; and after the incorporating step, forming a stream of the mixture of pieces of solid materials and directing the stream toward a rotating cylinder, the rotating cylinder including a magnet located within a rotating cylinder to create the magnetized portion, which is on an outer surface of the rotating cylinder, the rotating cylinder being oriented perpendicular to a direction of the stream of the mixture of pieces of solid materials, the rotating cylinder rotating in a direction opposite a direction of said stream, the mixture of pieces of solid materials contacting the rotating cylinder along a portion of the outer surface traveling upward such the mixture of solid materials is separated into a forward moving group that falls feely forward and a backwards moving group that is carried backwards with the rotating cylinder due to a combination of magnetic and frictional forces on each piece.

10. The method of claim 9, wherein the pieces are particles having a size of between about 2 mm and about 10 mm.

11. The method of claim 9, wherein incorporating the ferromagnetic particulate material into the mixture of pieces of solid materials is part of a process of separating at least a portion of the mixture of pieces of solid materials into at least two groups based on the density of the different components of the mixture of solid materials after the incorporation of the ferromagnetic particulate material.

* * * * *

UNITED STATES PATENT AND TRADEMARK OFFICE

CERTIFICATE OF CORRECTION

PATENT NO. : 8,056,728 B2
APPLICATION NO. : 12/414838
DATED : November 15, 2011
INVENTOR(S) : Brian L. Riise et al.

It is certified that error appears in the above-identified patent and that said Letters Patent is hereby corrected as shown below:

Column 30, Line 13 (Claim 9), please delete “feely” and insert --freely--, therefor.

Signed and Sealed this
Twenty-sixth Day of February, 2013

Teresa Stanek Rea
*Acting Director of the United States Patent and Trademark Office*